US007410148B2

(12) United States Patent
Arzouman

(10) Patent No.: US 7,410,148 B2
(45) Date of Patent: Aug. 12, 2008

(54) COMMERCIAL LIFTING DEVICE-POWER UNIT

(76) Inventor: Harry H. Arzouman, 26 Mainsail Dr., Corona Del Mar, CA (US) 92625

( * ) Notice: Subject to any disclaimer, the term of this patent is extended or adjusted under 35 U.S.C. 154(b) by 0 days.

(21) Appl. No.: 11/590,176

(22) Filed: Oct. 31, 2006

(65) Prior Publication Data

US 2008/0099739 A1 May 1, 2008

(51) Int. Cl.
*B66F 3/00* (2006.01)

(52) U.S. Cl. ..... 254/8 B; 254/2 B; 254/133 R

(58) Field of Classification Search ..... 254/8 B, 254/112, 108, 102, 89 R, 133 R, 134, 7 B, 254/10 B, 120, 130, DIG. 1, DIG. 3, DIG. 12, 254/DIG. 16, 8 R, 2 B See application file for complete search history.

(56) References Cited

U.S. PATENT DOCUMENTS 4,289,298 A * 9/1981 Kameda ..... 254/8 B
4,589,630 A * 5/1986 Arzouman ..... 254/7 B
4,641,813 A * 2/1987 Arzouman ..... 254/8 B
4,687,788 A * 8/1987 Hillshafer et al. ..... 521/163
4,960,264 A * 10/1990 Arzouman et al. ..... 254/8 B
5,110,089 A * 5/1992 Slay ..... 254/8 B
5,183,235 A * 2/1993 Arzouman et al. ..... 254/8 B
2003/0218156 A1* 11/2003 Arzouman ..... 254/8 B
2003/0218157 A1* 11/2003 Arzouman ..... 254/8 B
2003/0218158 A1* 11/2003 Arzouman ..... 254/8 B
2003/0218159 A1* 11/2003 Arzouman ..... 254/8 B

* cited by examiner

*Primary Examiner*—Lee D Wilson
(74) *Attorney, Agent, or Firm*—Roger C. Turner

(57) ABSTRACT

A power unit for use with a jack stand and a lift bridge has a rectangular frame with a forward end having a pair of separated elongated extensions for supporting the jack stand. The extensions extend about 1.50 inches beyond the latch finger of a positioned jack stand. A pair of side flanges extend upwardly from the frame with a "U" shaped retaining channel attached horizontally therein. A pair of lift arms are interconnected at the rearward ends by a lateral push bar that slides within the retaining channels by the ram of a hydraulic cylinder. A pair of connecting arms are pivotally connected near the forward end of the frame and the central portions of the lift arms. The forward ends of the lift arms have a pair of frustaconical discs for self-aligning engagement with the lower ends of the lifting plate of the jack stand. The power unit includes a lift bridge for positioning at the forward ends of the lift arms. The power unit has a tubular handle with T bar hand grip, rotatable knob for controlling the cylinder, and a control lever at the proximal end, and a yoke at the distal end pivotally attached to the rearward end of the frame. The yoke includes a cylindrical disc with peripheral notches therein that are engageable by a lug on a foot operated handle for controlling the position of the tubular handle of the power unit. The commercial power unit further includes a safety mechanism for mechanically securing the lift arms in an elevated position, and that is releasable by the control lever.

12 Claims, 22 Drawing Sheets

FIG. 20
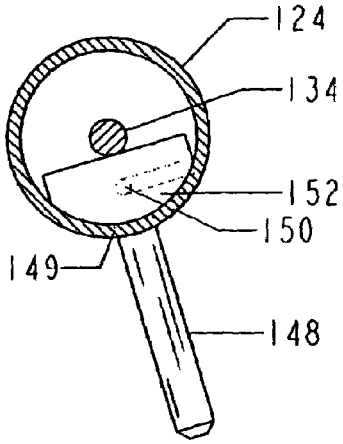
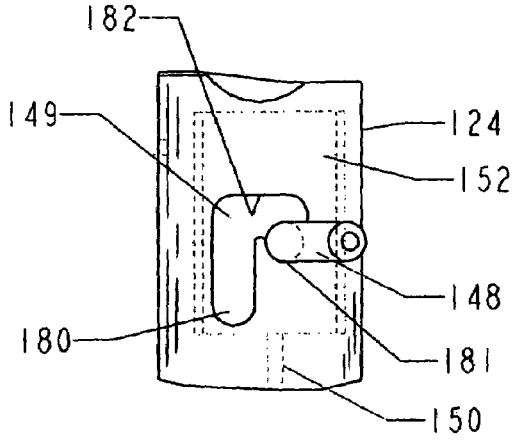
FIG. 18
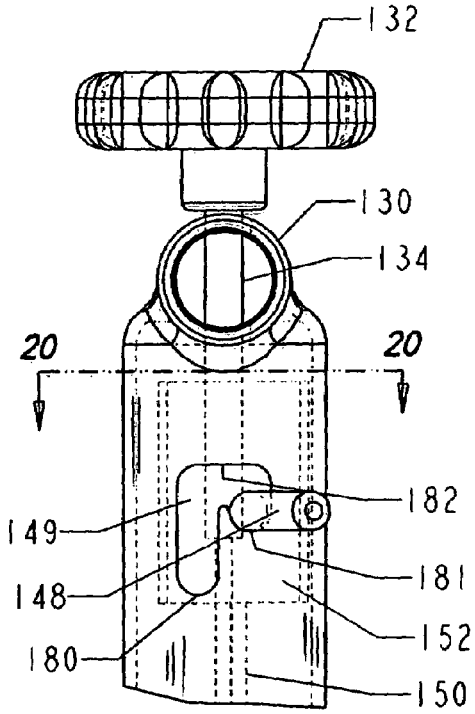
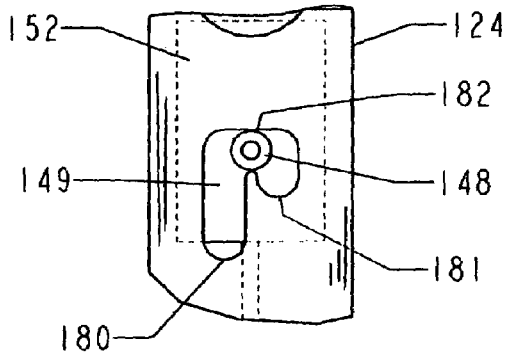
FIG. 17
FIG. 19

COMMERCIAL LIFTING DEVICE-POWER UNIT

CROSS REFERENCE TO RELATED APPLICATIONS

Applications have been filed directed to a Commercial Lifting Device Power Unit, —Self Aligning Jack Stand, —Two-Position Bridge, —Slide-Forward Bridge, —Safety Mechanism, —Handle Controls, —Frame Locking Mechanism, and —Power Unit Controls, as described in the present specification.

BACKGROUND OF THE INVENTION

The invention relates to a commercial system for lifting and supporting an object i.e. a corner of an automobile; particularly to a two part jacking system including an improved robust power unit that can be used to place and elevate an improved robust jack stand. The inventor of the present invention is a pioneer of the two part jacking system and holds numerous patents for two part jacking systems, some of which are described below.

Briefly, the commercial two part jacking system consists of a mobile power unit and a set of separate mechanical jack stands. Examples of the two part jacking system and mobile power unit are described in detail in Re. 32,715; U.S. Pat. Nos. 4,589,630 and 6,986,503. Some examples of the jack stands are described in detail in U.S. Pat. Nos. 4,553,727; 5,110,089; 5,183,235 and 5,379,974. The stands are capable of being vertically extended and retracted from the garage floor or road surface and, when extended, can be locked in place at a desired position by a ratchet and pawl assembly. The power unit has a wheeled mobile chassis adapted to carry a plurality of the jack stands, and has a pair of lift arms adapted to mate with the outermost jack stand for placement and removal.

In use, the commercial mobile power unit is operated from its handle. It is maneuvered under a vehicle to place a jack stand in a desired location for lifting and supporting the vehicle. The power unit is activated from the handle, and the jack stand is then extended vertically to the desired height, thus lifting the vehicle on the stand. By operating the controls at the end of the handle, the operator can cause the power unit to disengage from the stand, and the stand will remain locked in its extended supporting position under the vehicle.

After the stand is raised and locked in place supporting the vehicle, or other load, in an elevated position, the power unit lift arms are lowered and the power unit is disengaged from the stand and pulled away, leaving the stand in position supporting the load. Another jack stand, carried within the chassis, is automatically transferred to the forward end the chassis for placement at another desired location of the vehicle or for use in lifting and supporting another vehicle.

To lower the vehicle and remove the stand, the power unit is maneuvered to re-engage with the stand. The engagement causes any existing jack stands carried within the chassis to be automatically transferred rearward within the chassis. By manually operating a control at the end of the handle, the operator can cause the power unit to re-engage with the stand, and to disengage the ratchet locking mechanism of the stand, and to lower the stand to its original position. The power unit remains engaged with the stand and can be pulled away from the vehicle with the stand carried within the chassis.

The original commercial power units were adapted to carry up to four jack stands within the chassis. Additional jack stands could be acquired to reload the power unit, so that a single power unit could be utilized to efficiently place and actuate numerous jack stands. It was found that many commercial users would utilize all of their available jack stands, and the power unit was thereafter useless until another jack stand was available to be extracted and reused. The present inventor developed a slide forward bridge that adapted the power unit to function as a load-lifting jack to more fully utilize the power unit. This invention is illustrated in U.S. Pat. No. 6,779,780 entitled Lift Bridge For Use With a Power Unit and a Load Lifting Jack, along with several other patents related to additional features of the lifting system.

In the development of these lifting devices, several design challenges were presented that led to improved, innovative components and assembles of the present invention.

One such design challenge of the jack stand related to a lifting plate raised by the ends of a pair of lift arms on the power unit would sometime shift during lifting, and required redesign of these mating components so they would be self-aligning.

Another design challenge of the jack stand related to a locking mechanism that retained the second frame during elevation of the control frame was not reliable and had a short life, and required redesign with specific new cam angles, materials and heat treating specifications.

Another design challenge of the power unit related to the original hydraulic ram operating on the middle of the lift arms and required excessive and pivotal travel. A new design pushing directly on the rear of the lift arms, and retained within rugged retaining channels was developed.

Another design challenge was to improve the control features of the handle during use, and to improve the handle for movement of the power unit and for compact storage of the handle on the power unit for shipping and when the power unit was not in use.

Another design challenge was that a manual lift bridge should be provided for the basic power unit, stored at a first position on the power unit; and readily available to be placed at a second position on the forward ends of the lift arms, so that the basic power unit could also function as a load lifting jack.

Another design challenge related to the lift arms of the power unit having an extruded recessed channel in the upper surface for retaining a compression spring for advancing the automatic-slide-forward-bridge. The lift arms were difficult to manufacture, had a high scrap rate and were thus not robust to produce. Also, the slide-forward bridge was difficult to produce, was difficult to assemble, and was not as smooth in operation as desired. A new slide-forward bridge for the mobile commercial power unit needed to be developed.

Another design challenge resulted from the redesign of the retaining channels for the rearward ends of the lift arms. This led to the design of a new safety mechanism to lock the rear ends in position when the power unit was functioning as a load lifting jack.

In view of the foregoing design challenges, it is an object of the present invention to provide an improved commercial power unit having components that are robust to manufacture and assemble.

It is another object to provide an improved jack stand that has a self aligning lift plate.

It is another object to provide an improved jack stand with a reliable locking mechanism between the extendable frames.

It is another object to provide a power unit with improved controls for the jack stand.

It is another object to provide an improved handle for the power unit for control of the jack stand; and for positioning the handle for movement, shipment and storage of the power unit.

It is another object to provide a manual two-position bridge component that can be reliable and durable in use and can be stored on the power unit.

It is another object to provide and an automatic-slide-forward-bridge assembly having components that are robust to produce and assemble, and that are reliable and durable in use.

It is another object to provide an improved durable safety mechanism for a hydraulic jack and for the power unit when it is used with the bridge directly as a load lifting device.

SUMMARY OF THE INVENTION

The foregoing objects of a commercial power unit for use with a jack stand having components that are robust to manufacture and assemble are accomplished by the commercial power unit of the present invention. The jack stand includes a flat horizontal base plate having a rectangular base assembly with longitudinal side rails and a latch finger extending from each end. A lower tubular frame extends vertically and has an upper tubular frame telescopically operable therein and has a rectangular lifting plate on the upper end of the upper frame. The lift plate has a pair of side flanges with lower ends with inclined surfaces.

The power unit includes a rectangular frame having a forward end for operating a jack stand; a middle portion for retaining the lifting mechanism; a rearward end for controlling the power unit. The bottom has an elongated rectangular slot with the slot having a pair of separated elongated extensions extending to the side of the frame. The extensions have laterally rounded noses thereon and have a length extending about 1.50 inches beyond the latch finger of a positioned jack stand. The frame has a rearward portion that is angled longitudinally upwardly a few degrees for facilitating mobility, and has a hydraulic cylinder with a control valve and an actuator piston thereon. A pair of longitudinal side flanges extend upwardly from the frame, with each flange has a "U" shaped retaining channel attached horizontally along the middle portion of the frame. A pair of wheels are attached to the exterior sides of the flanges on lateral axels near the rearward end of the frame.

A pair of lift arms acting in parallel are interconnected at the rearward ends thereof by a lateral push bar. The ends of the push bar are slidably retained within the respective retaining channel of the frame. The forward ends of the lift arms are extendable upwardly at the forward end of the frame. A pair of connecting arms acting in parallel have forward ends pivotally connected near the forward end of the flanges of the frame, and have the rearward ends pivotally connected near the central portion of the respective lift arm. The hydraulic cylinder has an extendable and retractable ram attached to the lateral push bar; so that when the ram is extended, the rearward ends of the lift arms are translated forward along the longitudinal retaining channels in the respective flange of the frame and the forward ends of the lift arms are extended upwardly at the forward end of the frame.

The forward ends of the lift arm have a pair of frustaconical discs pivotally attached to the inner sides with upper surfaces inclines upwardly at an acute angle ranging from about 15° to about 30°, for self-aligning engagement with the lower ends of the lifting plate of the jack stand.

The power unit further includes a lift bridge positioned at the forward ends of the lift arms so that the power unit can function directly as a load lifting device. A two-position lift bridge further includes a rectangular plate and has a threaded aperture in the center thereof with a screw-out saddle therein. The bottom surface of the sides of the plate has a pair of cylindrical pins extending downward for securing the lift bridge in position. The power unit has a rear cover extending from the side flanges at the rearward end of the frame, with the cover having apertures therein for receiving the shaft and pins extending from the bottom of the bridge for the stored position of the bridge.

The power unit has a pair of leveling pads pivotally attached to the outer sides of the forward ends of the lift arms and having a vertical aperture therein for receiving the cylindrical pins of the lift bridge. The leveling pads providing another position for the two-position bridge to be inserted, whereby the power unit is operable directly for use as a load lifting device.

The power unit can alternatively include an automatic-slide-forward lift bridge, wherein each leveling pad further include a flange extending outward for use with the lift bridge. The slide-forward lift bridge includes a rectangular plate having inner channels in the bottom sides for engaging the outward flange of the leveling pads. A pair of telescoping sleeves having an internal spring is utilized to bias the lift bridge toward the forward ends of the lift arms. The forward ends of the lift arms are elongated beyond the pivot connection of the leveling pads, and the bottom surface of the rectangular plate further includes recesses for receiving the elongated ends of the lift arms when in the elevated position, for locking the slide-forward-bridge onto the lift arms.

The commercial power unit has a tubular handle with T bar hand grip and control handle at the proximal end, and a yoke on the distal end pivotally attached to the rearward end of the frame. The yoke includes a cylindrical disc with peripheral notches therein that are engageable by a lug on a foot operated handle for controlling the position of the tubular handle of the power unit.

The commercial power unit further includes a safety mechanism for mechanically securing the lift arms in an elevated position, and is releasable by the control lever. The mechanism includes a toothed rack bar in the U channel tracks; and a slidable dog extending from the ends of the push bar for engaging a corresponding tooth of the rack bar. The dogs are biased in the extended position toward the rack bar, but has cables that are linked to the control handle for releasing the dogs to lower the lift arms of the power unit.

BRIEF DESCRIPTION OF THE DRAWINGS

While the novel features of the invention are set forth in the appended claims, the invention will be better understood along with other features thereof from the following detailed description taken in conjunction with the drawings, in which:

FIG. 17 is a fragmentary side elevational view of the handle and control lever taken along 17-17 of FIG. 16;

FIG. 18 is a view like FIG. 17 but showing a different position of the control lever;

FIG. 19 is a view like FIG. 17 but showing a different position of the control lever;

FIG. 20 is a sectional view of the handle and control lever taken along 20-20 of FIG. 17;

DETAILED DESCRIPTION OF THE INVENTION

The figures and the following specification may describe and define several distinctive inventions that are interrelated within a lifting and supporting system, and may be included in patents (or pending applications) having distinctive sets of claims directed to the respective invention. Also, the improved power unit and jack stands are discussed and described in terms of an automotive jack system, but it should be understood that the system is not limited to automotive uses and can be utilized for lifting and supporting any type of load.

The components are fabricated from strong, rugged steel materials that are precisely retained in fixtures during any punching and welding processes to retain the designed configuration for a very high-yield and robust fabrication. The present Jack Stand and Power Unit function similarly to those described in U.S. Pat. Nos. 5,183,235 and 5,110,089 which are incorporated herein by reference; however, the present Jack Stands and Power Unit are fabricated from much heavier and upgraded materials; and further include specific improved features as herein described. The improved design and features result in robust manufacturability, and reliability and durability of the jacking system for the commercial user. The system is initially introduced in a 3-ton capacity model, and a 2-ton capacity model, both having a lifting range from about 7 inches to a maximum of about 19 inches for the jack stands and for the power unit.

Robust Commercial Lifting System

Figure 1:
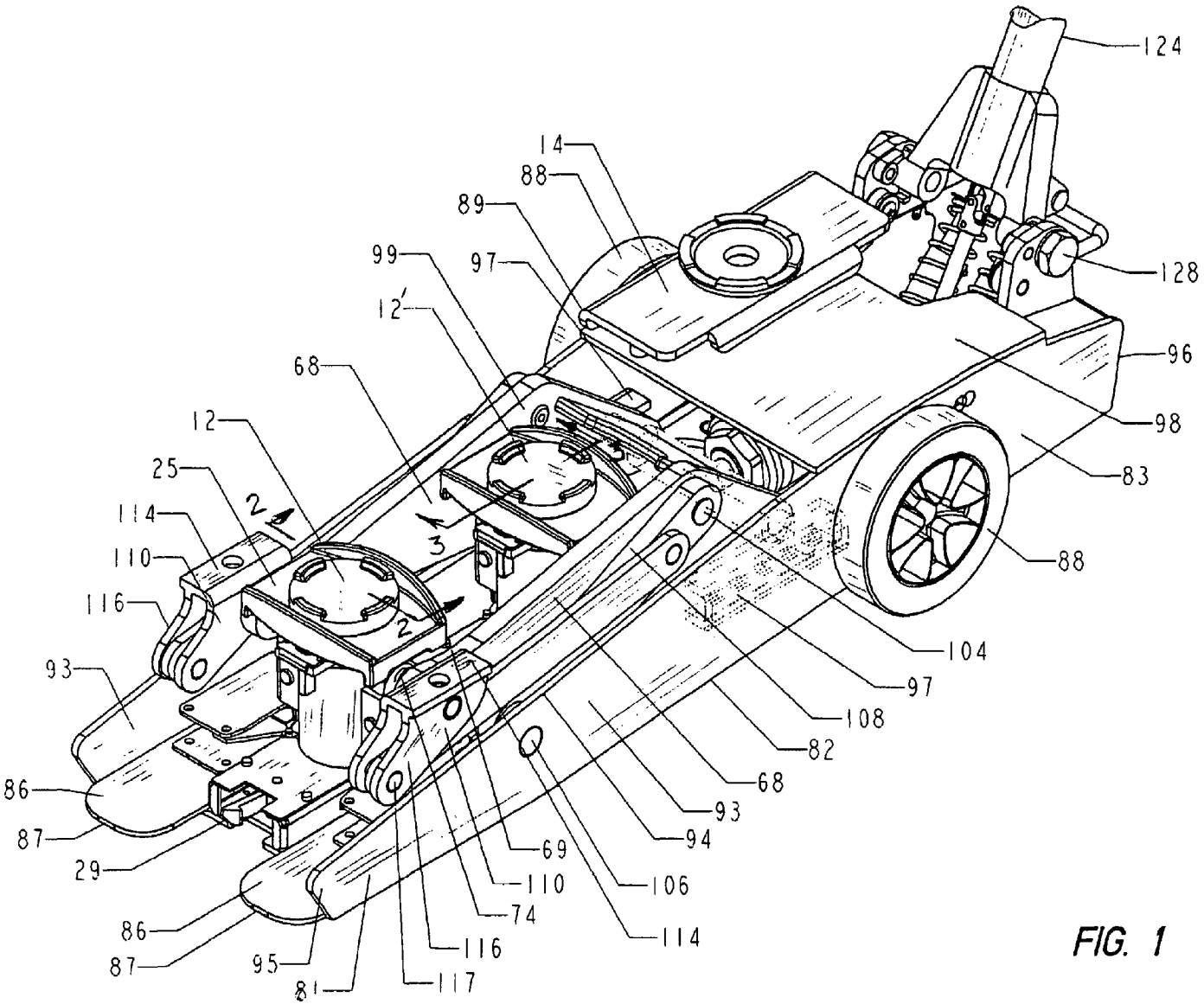
FIG. 1 is top-front perspective view of a power unit carrying two jack stands.
Figure 3:
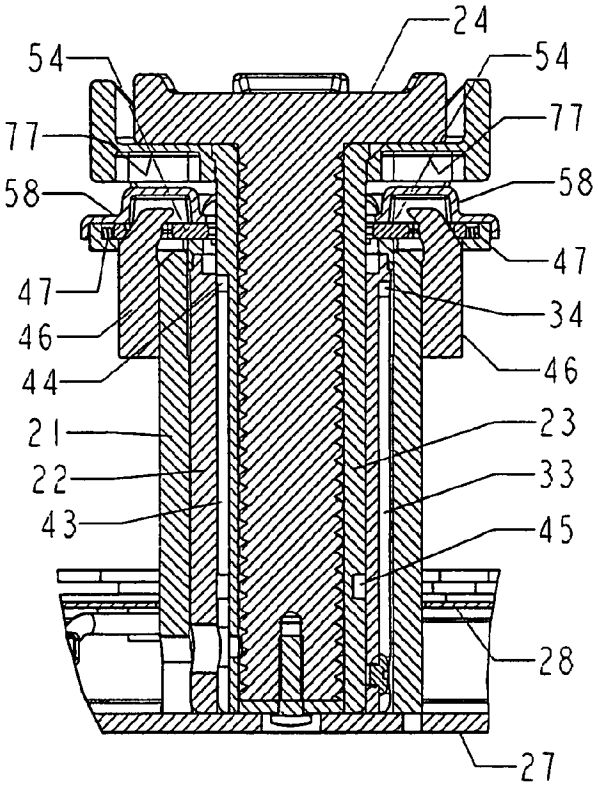
FIG. 3. is side elevational sectional view of the jack stand taken along 3-3 of FIG. 1.
Figure 2:
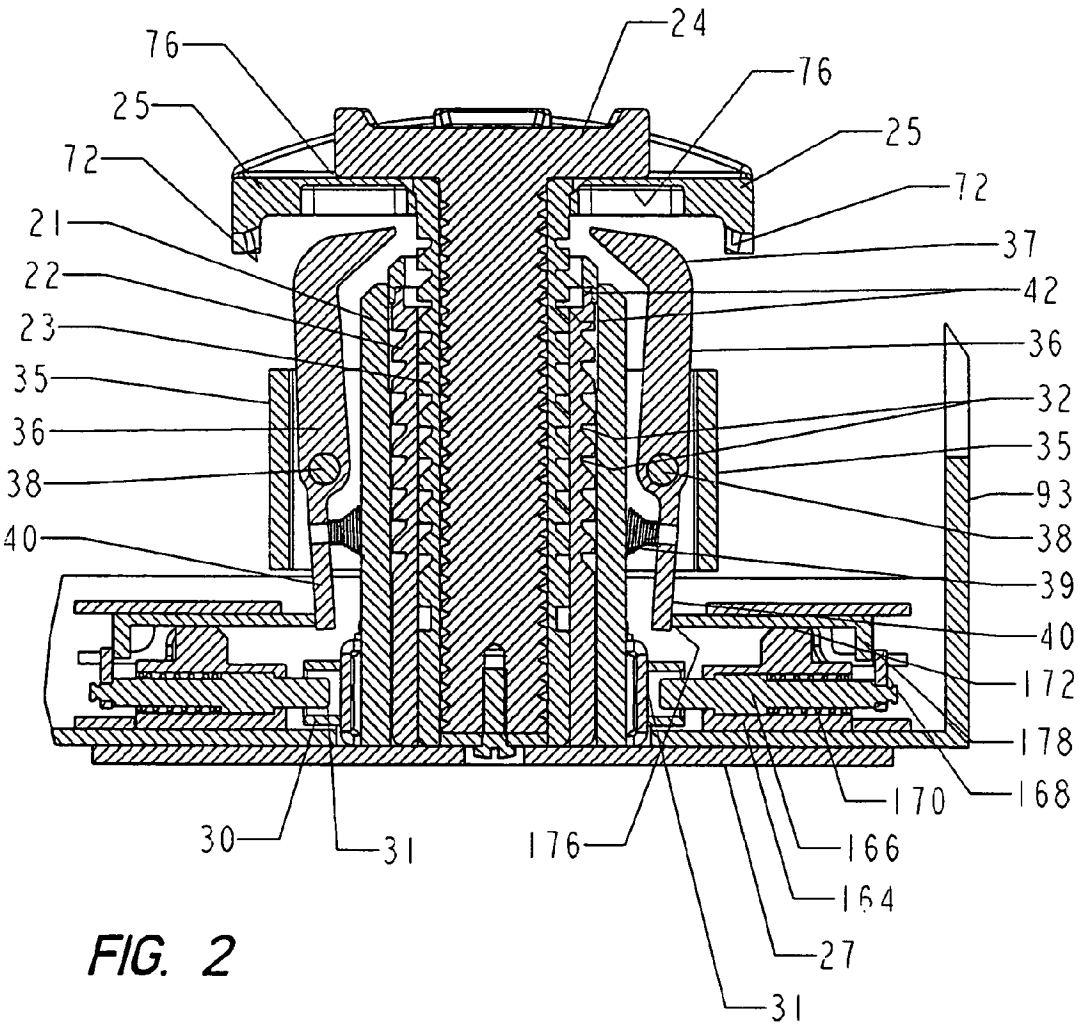
FIG. 2. is a front elevational sectional view of the jack stand taken along 2-2 of FIG. 1.
Figure 5:
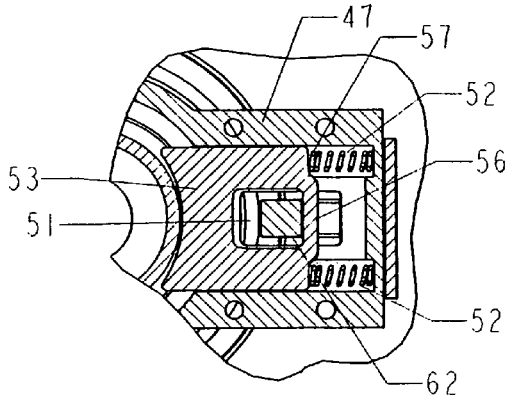
FIG. 5 is a sectional view taken along 5-5 of FIG. 4 showing the second frame locked to the third frame (prior to the lifting of the second frame)
Figure 6:
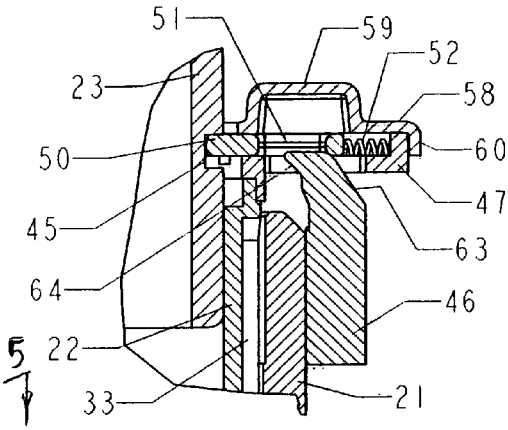
FIG. 6 is sectional view taken along 6-6 of FIG. 4.
Figure 4:
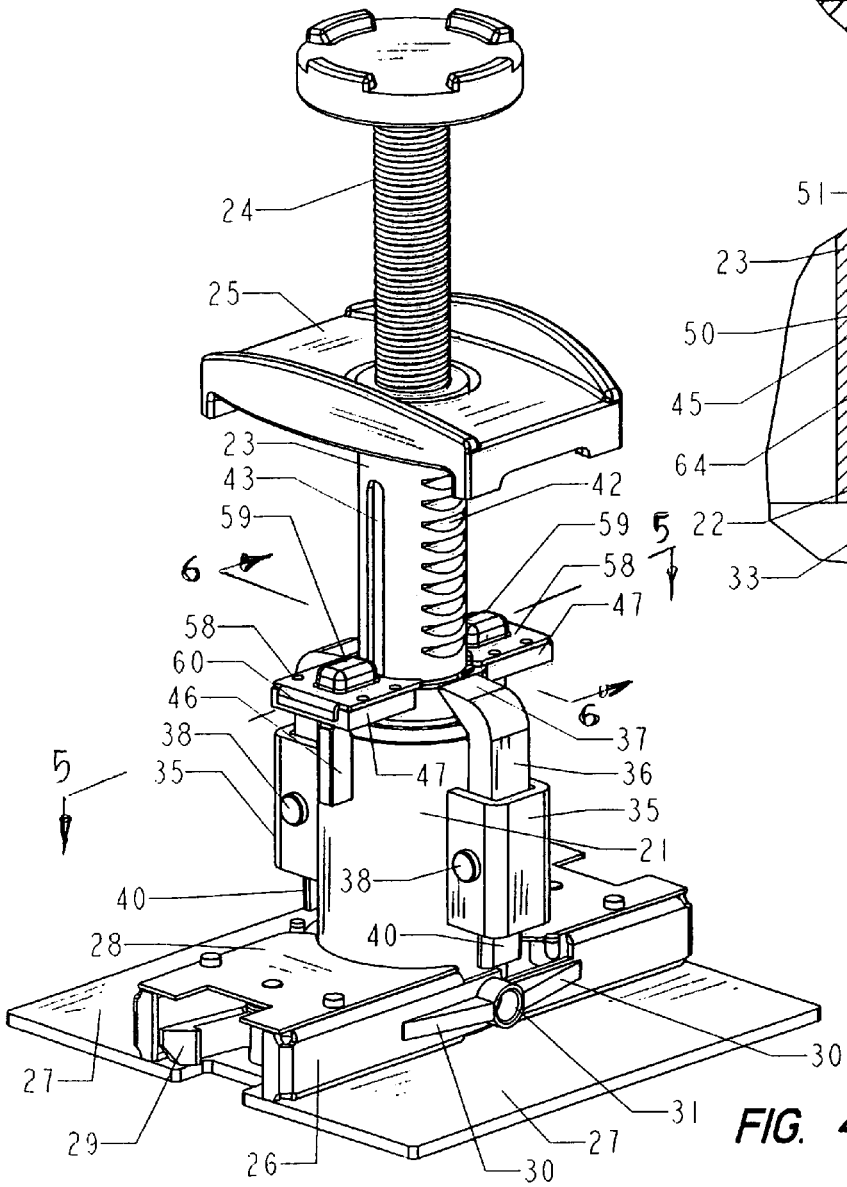
FIG. 4 is top-front perspective view of the jack stand having the third frame fully elevated.
Figure 8:
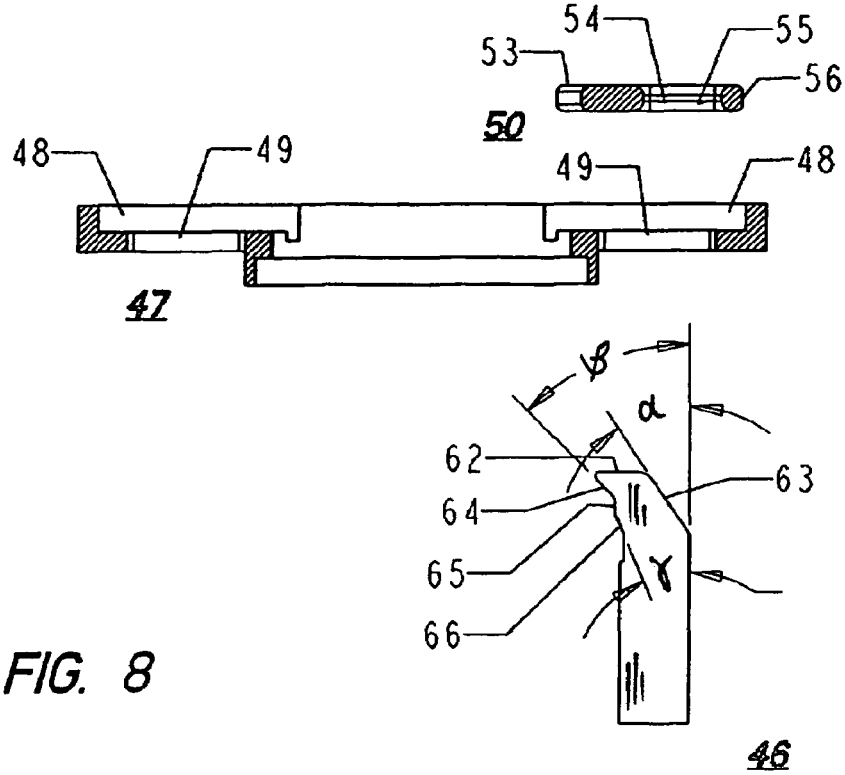
FIG. 8 is an exploded sectional side view of the components of FIG. 7.
Figure 7:
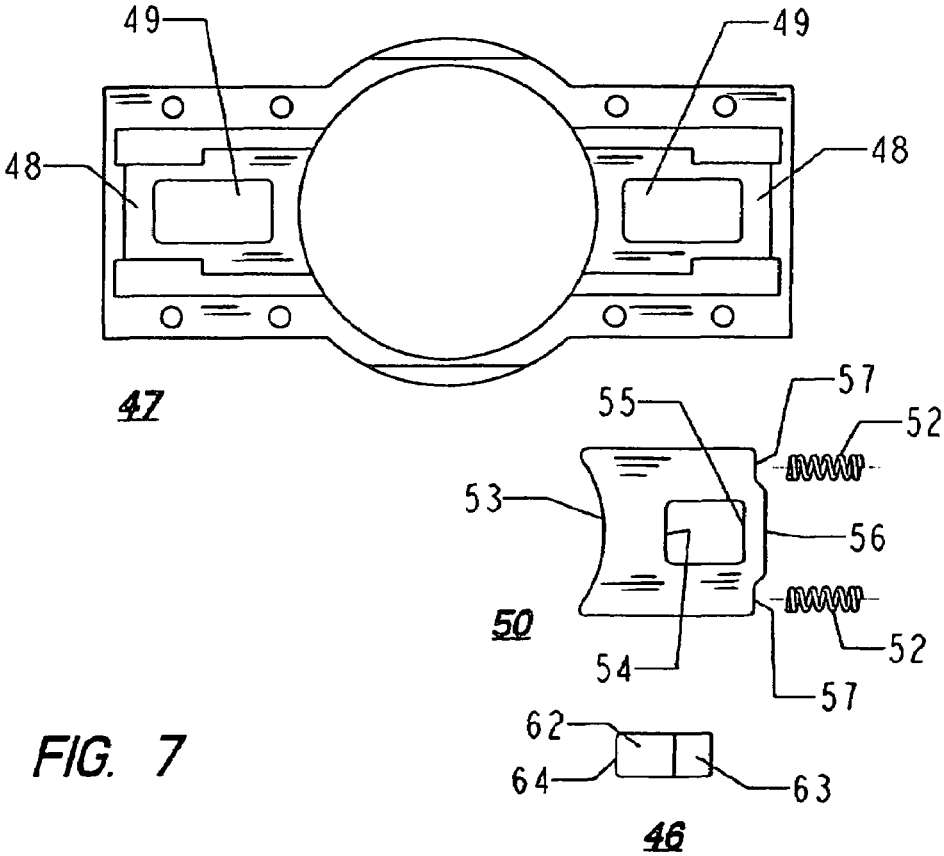
FIG. 7 is a top plan view of the components of the frame locking mechanism of the stand.

Referring first to FIG. 1 there is illustrated a first embodiment of a mobile power unit 10 of the present invention for conventional use with one or more jack stands 12 and 12' of the present invention for lifting and supporting a load. The power unit is also readily convertible for use directly as a load lifting jack by a manual two-position lift bridge 14. The lift bridge as shown in FIG. 1 is placed on the power unit in its first (stored) position, and can be manually placed into its second (operative) position (see FIG. 29) on the forward end of the power unit to convert the power unit for use directly as a load-lifting jack. The two-position lift bridge will be discussed later in detail. The jack stands are designed to have a very low initial height, and the power unit is designed to be very sleek, having a smooth, arcuate, low-profile for maneuvering into low lifting applications and having a unique functional and industrial appearance. The system will be discussed in terms of its structure including significant improved features by the use of descriptive sub-headings.

Robust Commercial Lifting Device—Jack Stand

Referring also to FIGS. 2-11, the overall arrangement of the extendible jack stand 12 includes a horizontal base assembly 26, a vertical tubular first frame 21 which is fixedly attached to the base assembly, a vertical tubular second frame 22 which is telescopically received within the first frame 21, and a vertical tubular third frame 23 which is telescopically received within the second frame 22. There is an optional vertical fourth frame 24 (a screw-out saddle) threaded into the upper end of third frame 23. The third frame 23 has an improved unique lifting plate 25 on the upper end thereof and will be discussed later in detail. The base assembly is provided for aligning and locking the jack stand within the power unit 10, and a ratchet mechanism is provided for establishing a precise extension position of the jack stand.

The base assembly 26 includes a bottom plate 27, an upper plate 28 supported on side walls, a pair of spring-loaded latch fingers 29 occupying respective ends of the space between plates 27 and 28, and a pair of lateral ramps 30 (each having a lateral aligning hole 31 therein) is secured to the respective side walls forming side rails thereon. The latch fingers 29 function to secure two or more jack stands 12, 12', etc., in a series relationship within the frame of the power unit 10. The lateral ramps 30 initially provide side rails (that are above and parallel with the bottom plate 27) that are engagable by the separated forward extension ends of the frame of the power unit 10 that straddle the base assembly 26 for loading the jack stands into the power unit, as shown in FIG. 1. The lateral ramps and aligning holes 31 are further utilized for aligning and locking the jack stand into the frame of the power unit, and will be further described later along with the related components of the power unit.

The tubular first frame 21 has a lower end that extends downward through the upper plate 28 of base 26 and is welded to bottom plate 27. The tubular second frame 22 is telescopically received within first frame 21. The second frame has vertical rows of ratchet teeth 32 formed on two opposite sides of its outer wall surface. In order to maintain the rotational orientation of the ratchet teeth 32 relative to base assembly 26, there is a vertical groove 33 formed at one point on the circumference of the outer wall surface of second frame 22 and which extends throughout most of the length of the second frame. A short pin 34, secured through an opening in the wall of first frame 21, extends into the groove 33 and thus secures the second frame 22 against rotation (see FIG. 3).

The first frame 21 has a pair of ratchet arm housings 35 secured to opposite sides of its exterior surface and aligned with the ratchet teeth of the second frame 22. Within each such housing there is a vertically extending ratchet arm 36 having a tooth or pawl 37 formed on its upper end. Each ratchet arm is supported near its longitudinal center by a pivot pin 38 which is in turn secured within the corresponding housing. A tapered compression spring 39 forces the lower end of each ratchet arm outwar4 so that the pawl 37 on its upper end will reliably engage the ratchet teeth of second frame 22 (or third frame 23). The lowermost end 40 of each ratchet arm 36 is exposed beneath the corresponding housing where a horizontal force may be applied for releasing the engagement of its pawl 37 with the ratchet teeth.

The tubular third frame 23 likewise has vertical rows of ratchet teeth 42 formed on two opposite sides of its outer wall surface, similarly as the second frame 22. In order to maintain the rotational orientation of the ratchet teeth 42 relative to the base assembly 26 there is a vertical groove 43 formed at one point on the circumference of the outer wall surface of third frame 23 and which extends throughout most of the length of the third frame. A short pin 44 secured through an opening in the wall of second frame 22 extends into the groove 43 and thus secures third frame 23 against rotation.

Commercial Jack Stand—Improved Frame Locking Mechanism

Referring particularly to FIGS. 3-9, as the power unit 10 elevates the lift plate 25 of the jack stand 12, the third tubular frame 23 is extended upward and the ratchet teeth thereon are engaged by the ratchet arm pawls 37 to secure the third frame in position. However, there is typically internal friction between the telescopic tubular frames, and the second tubular frame 22 (unless secured within first frame 21) tends to be prematurely extended upward along with the third frame. Upon the premature elevation of the second frame, the ratchet teeth thereon are then engaged by the pawls, but the ratchet teeth on the third frame are otherwise not engaged or locked. The third frame is lifted by the power unit, but is not locked or supported; and when the lifting by the power unit is released, the third frame drops from the force of the load.

This problem was "conceptually" solved with a dual locking mechanism for automatically locking the second frame in fixed relation to the first frame while the third frame is being raised, and for locking the third frame in fully extended relation to the second frame while the second frame is being raised (see FIG. 3), as generally described in U.S. Pat. No. 5,110,089. However, the components of the locking mechanism had a relatively short life and required frequent repair.

The basic dual locking mechanism includes a pair of upwardly extending fingers 46 fixedly secured on opposite sides to the upper end of the first frame 21; a guide member 47 secured to the upper end of the second frame 22 and extending horizontally outward therefrom, and having a pair of opposed recessed channels 48 therein with slotted openings 49 therein for receiving upper ends 62 of the respective fingers; and a pair of latch members 50 each horizontally slidable in the recessed channels of the guide member and having a slotted opening 51 therein for receiving the upper end of one of the fingers. The mechanism includes a set of suitable compression springs 52 for urging the latch members inwardly along the guide member at the upper end of the second frame. The third frame 23 has a horizontal groove 45 in its outer surface near the lower end thereof for receiving the latch members when the third frame is fully extended (see FIGS. 4-6).

Each latch member 50 has a horizontally curved inner end 53 (conforming to the diameter of the tubular frame 23) having a rounded nose thereon, and the slotted opening therein has an inward edge 54 and an outward edge 55 thereof for cooperating with the upper end of the respective finger 46. The latch member has an outer end 56 having suitable notches 57 for abutting one end of the springs 52 that are nested within the outer ends of the guide member 47. The latch members and the springs are slideably retained and enclosed within the guide member by a pair of covers 58 each having a dome 59 thereon providing clearance for the upper end of the fingers, and having side and outer end flanges 60 for fastening the cover to the upper surface of the guide member.

Each finger 46 has the upper end 62 extendable into the slotted openings 51 of the latch members 50. The upper end 62 has an angled outward surface 63 thereon that acts as a cam for engaging the outward edge 56 of the slotted opening in the latch member, and has an inward surface 64 that act as an angled notch for engaging with the inward edge 54 of the slotted opening of the latch member.

The fingers 46, the guide member 47 and the latch members 48 are in frictional engagement and are locked and unlocked every time the jack stand is raised and lowered. After extensive analysis and development of the interaction of these components, specific materials, levels of heat treating, and specific angles of the upper end of the fingers have been determined, resulting in robust manufacturing, reliable commercial use, and extended life of the jack stands. These unique refinements are described below in detail.

More particularly, each finger has the upper end 62 with the outward surface 63 thereof extending outwardly and downwardly suitably inclined at an angle "$\alpha$" ranging from about 28° to about 38°, and preferably at about 32°. This cam angle of about 32° provides smooth engagement with the outward edge 55 of the slotted opening in the latch member 50 for sliding the latch member outwardly along the recessed channels 48 of guide member 47.

The upper end 62 has the inward surface 64 thereon suitably extending outwardly and downwardly at an angle "$\beta$" ranging from about 40° to about 50° and preferably at about 45° for a vertical distance of about the thickness of the latch member 50, and then having a generally vertical portion 65 extending downwardly a distance of about the thickness of the latch member. The vertical portion 65 of the inward surface acts as a recessed notch with the upper end 62 extending inwardly over the inward edge 54 in the slotted opening of the latch member 50 and thereby captures the second frame 22 against any premature upward movement. The angle of 45° (even at low range 40°) insures that there is no binding of the inward edge 54 with the finger during the engagement of the outward edge 55 by the angled outer surface 63 acting at 32° (even at high range 38°), and further provides a smooth gradual unlatching of the finger over this surface when the latch member slides into the groove 45 of the third frame 23 when the third frame is fully extended (see FIG. 6).

The inward surface 62 of the finger continues further with a clearance portion 66 that extends outwardly and downwardly inclined at a suitable angle "γ" ranging from about 18° to about 28° and preferably at an angle of about 23° a vertical distance of about the thickness of the latch member. This portion 66 of the upper end provides some tolerance and clearance for welding the finger to the first frame 21 and insures clearance with the latch member during use.

The fingers 46, guide member 47, and latch members 50 components were initially formed by conventional stamping processes, but this method was not successful for providing the desired working surfaces needed for reliable performance with a long commercial life. The preferred method for forming these components is by the well known "lost wax" casting process, and this process results in very satisfactory performance.

In the "lost wax" casting process, a series of impressions of the components are first molded in wax. These wax moldings are then dipped, sprayed or otherwise coated in a "plaster-of-paris" type material; and are allowed to harden; they are then heated and the wax is melted out, and the hardened materials are used as molds, to cast the components in the desired steel material. The process is repeated in production to produce each of the components.

The fingers 46, guide member 47, and latch members 48 are suitably cast out of 4130-4140 carbon steel. It has further been determined that these components should be of about the same hardness, and preferably are heat treated to a hardness of about 40-45 Rockwell C. Extended life tests of the jack stands have shown that heat treatment of the components to a hardness of less than 40 Rockwell C results in excess wear; and hardness above 50 Rockwell C result in components than are too brittle that tend to break.

The above described components cast from 4130-4140 steel, heat treated to 40-45 Rockwell C, and having the contoured fingers and latch members as defined, provide reliable locking of the respective frames when the jack stand is raised; and provides reliable unlocking of the respective frames when the jack stand is lowered, over an extended long commercial use of the jack stand.

Commercial Lifting Device—Self Aligning Jack Stand

Figure 9:
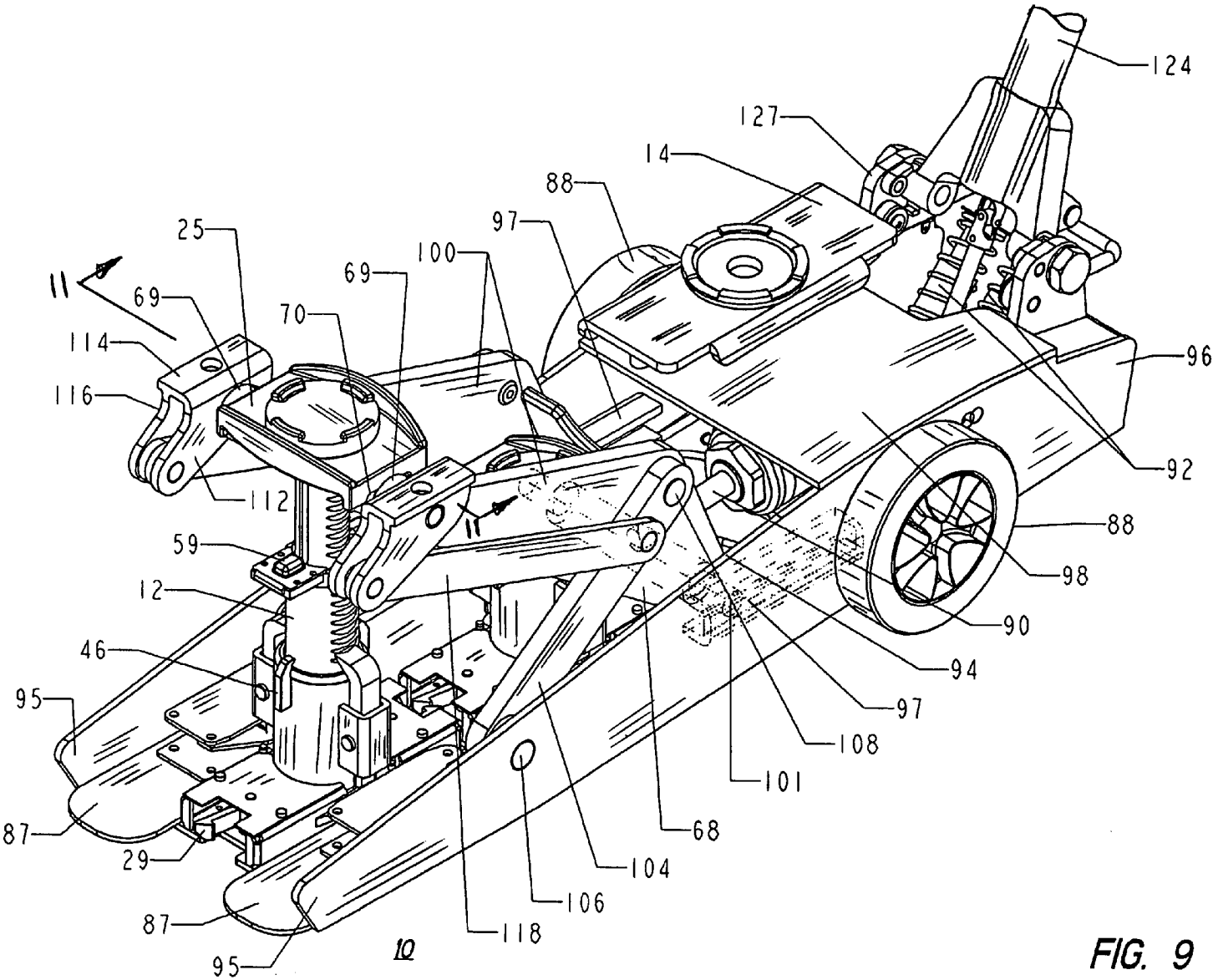
FIG. 9 is a front perspective view of the power unit, with the jack stand extended.
Figure 10:
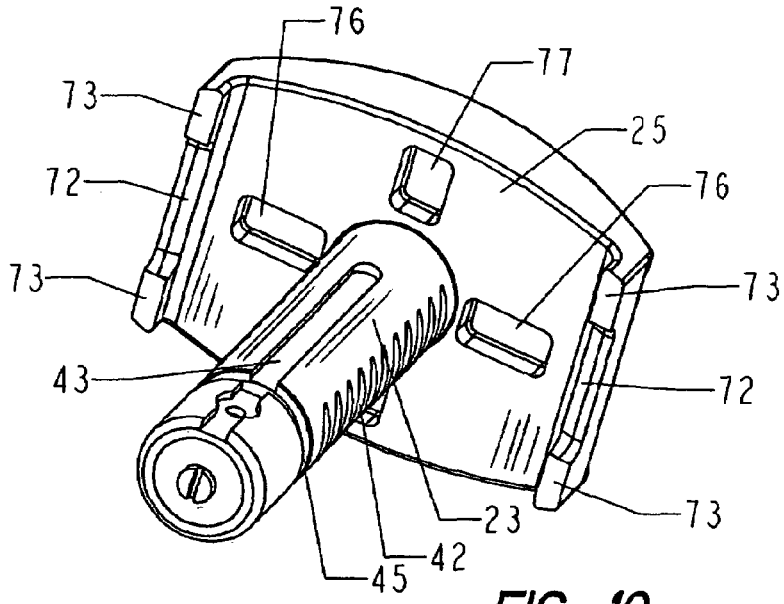
FIG. 10 is a bottom perspective view of the third frame and lift plate of the jack stand.
Figure 11:
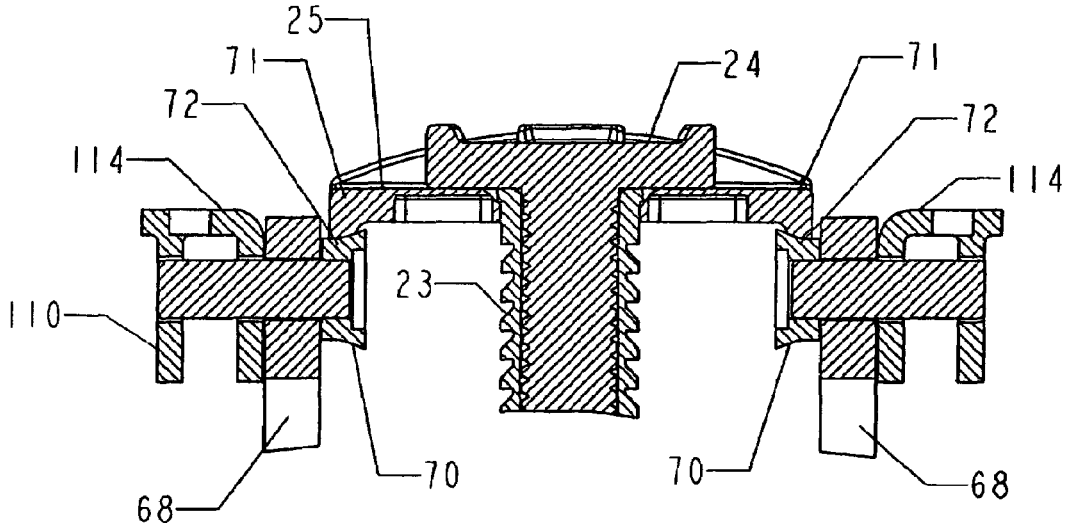
FIG. 11 is a sectional view taken along 5-5 of FIG. 9.

Referring now also to FIGS. 9-11, the commercial jack stand 12 has been further improved so that the lifting pad 25 tends to be self-centering during lifting by the commercial mobile power unit 10, and tends to be self-aligning to compensate for small movements of the load.

The power unit will be discussed later in more detail, but for purposes of the improvement of the jack stand, the power unit includes an improved feature related to a pair of parallel lift arms 68 having forward ends 69 thereof for engaging the lifting plate 25 of the jack stand. The inner sides of the forward ends of each lift arm includes a frusta-conical disc 70 rotatably attached to a lateral axel thereon. The greater diameter of the disc extends inwardly so that the upper surface thereof inclines upwardly at an acute angle ranging from about 15° to about 30°, and preferably at about 20°.

The lifting plate 25 comprises a rectangular plate attached to the upper end of the third frame 23, having parallel side flanges 71 extending downwardly therefrom. The side flanges each have a lower end 72 with an inner surface extending outwardly and downwardly at an acute angle for engaging the upper surface of the frusta-conical discs of the power unit. The acute angle should correspond with the angle of the frusta-conical disc, ranging from about 15° to about 30° and is preferably at an angle of about 20°. As shown, particularly in FIG. 11, the angular engagement of the bottom surfaces of the lifting plate and the upper surfaces of the discs, the lifting plate tends to seek a neutral balance laterally between the lift arms. The rotatable discs also provide for the lifting plate to translate along the upper ends of the lift arms, with small longitudinal shifts of the load relative to the jack stand (without tending to tip the jack stand).

As shown in FIG. 10, in a most preferable configuration of the lifting plate, the side flanges 71 have flat corner portions 73 extending downwardly therefrom. The corner portions create the lower end 72 to now be within central recessed portions 74 between the corner portions. The angled lower end 72 is provided only in the recessed central portions. The angled inner surface of the lower end 72 can readily engage the upper surface of the frusta-conical disc 70 to laterally center the lifting plate and longitudinally translate along the bottom of the lifting plate with any longitudinal shift of the load, as described above. And further, any longitudinal translation is limited to the recessed central portion 74 thereof, so that the lifting plate will not translate completely off of the discs in the event of a more sever shift of the load.

As discussed above, the bottom inner surface 72 of the recessed portion 74 of the lifting plate 25 extends outwardly and downwardly at an angle ranging from about 15° to about 30° and preferably at an angle of about 20° (corresponding to the upper surface of the disc 70).

Referring again particularly to FIG. 10, the lifting plate 25 has a lower surface 75 thereof further improved by a pair of recesses 76 therein for nesting the lifting plate over the pawls 37 of the ratchet arms; and a pair of recesses 77 for nesting the lifting plate over the domed covers 58 of the dual locking mechanism. The rugged robust design of the components of the commercial jack stand tends to increase the overall height of the jack stand, and the pairs of recesses 76 and 77 help to minimize the height of the commercial jack stand (to about 6 inches).

Robust Commercial Power Unit—Frame and Lifting Assembly

Referring now to FIGS. 1, 9, 14 and 15, the mobile commercial power unit 10 is shown for use with the jack stands 12, and for use with the lift bridge 14.

The power unit 10 has a generally rectangular frame 80 having a central longitudinal axis, a forward end 81 for loading and unloading the jack stands, a middle portion 82 for securing the lifting mechanism, a rearward end 83 for controlling the power unit, and a bottom 84 thereof. The bottom 84 (see FIG. 14) has a rectangular slotted opening 85 therein extending longitudinal from the forward end through the middle portion thereof. The opening is a little wider than the width of the base assembly 26 of the jack stand 12. The forward end has a pair of flat separated extensions 86 with laterally rounded noses 87 thereon extending from the edge of the slot to the respective side of the bottom of the frame, for straddling the jack stands. The separated extensions are used to ride up over the bottom plate 27 of the jack stand, to straddle the base assembly 26 thereof and to engage the lower surface of the side rails and ramps 30 thereof, to retain and transport one or more jack stands in the frame of the power unit.

The prior art power units utilized a frame with separated forward ends (as shown in phantom lines in FIG. 12) typically with a slotted openings therein that extended only to a distance corresponding to the end of the latch finger 29 of a jack stand that had been previously loaded into the power unit. The initial jack stand 12 could be readily straddled and loaded, but the loading of any additional jack stands 12' etc., required precise pre-staging to line-up squarely with the end of the bottom plate 27 and with the latch finger 29 of the additional jack stand. The separated extensions 86 of the frame of the present invention are extended about 1.50 inches beyond the latch finger and have rounded noses thereon. The improved extensions 86 of the power unit can readily straddle the base assembly 26 of the additional jack stand and self-align this jack stand squarely for loading and latching it into the power unit. This is a significant improvement in the efficient commercial use of the lifting system.

The bottom 84 of the frame further has the forward end 81 thereof substantially flat (for about 12 inches) for providing a solid lifting platform, and has the middle portion and rearward end thereof angled longitudinally upwardly (at about 5°) for facilitating mobility of the power unit by a pair of wheels 88 located near the rearward end 83 of the frame.

A hydraulic cylinder 89 having an extendable ram 90 at the forward end thereof, and having a rotatable control valve 91 at the rearward end thereof, is attached along the longitudinal center near the rearward end 83 of the bottom 84 of the frame. The hydraulic cylinder preferably utilizes dual piston type actuators 92 having a first piston actuator for rapidly extending the ram with only a few strokes, until a load exceeding about 150 pounds is encountered; the second piston actuator then takes over to extend the ram (i.e. to lift the load) in the conventional manner. This is another commercially efficient feature of the power unit 10.

The frame has a pair of longitudinal side flanges 93 extending upward from the bottom 84 thereof; and has the pair of wheels 88 attached to the outer sides of the flanges on lateral axels near the rearward end 83 thereof. Each side flange has an upper edge 94 with a rounded vertical nose 95 at the forward end 81 thereof and a smooth generally vertical blunted tail 96 at the rearward end thereof, and has a smooth arcuate contour extending upwardly from the rounded nose to about the height of the wheels and then downwardly mating with the blunted tail, providing an attractive appearance for the frame of the power unit. Each flange further includes a "U" shaped longitudinal retaining channel 97 facing inwardly and attached horizontally along the inner sides of the middle portion thereof.

The rearward end 83 of the frame includes a generally rectangular cover plate 98 that extends over and along the upper edges 94 of the side flanges 93 and covers the hydraulic cylinder 89 and some of the control mechanism. The cover plate is contoured to match the upper edge of the side flanges, and provides some protection for some of the components and a clean appearance for the rear of the power unit 10

The power unit includes the pair of lift arms 68 that act in parallel and have forward ends 69, middle portions 100 and rearward ends 101. The lift arms are interconnected at the rearward ends thereof by a lateral push bar 102, with the respective ends of the push bar slidably retained (in suitable pivotal bushings) within the respective retaining channel 97 of the flanges; and the forward ends of the lift arms extend toward the forward end 81 of the frame.

A pair of connecting arms 104 act in parallel and have forward ends 106 and rearward ends 108, have the respective forward end pivotally connected (at 106) near the forward end of the respective flange (and within reinforcing flange 107) of the frame 80. The respective rearward end is pivotally connected (at 108) on the middle portion 100 of the respective lift arm 68.

The hydraulic cylinder 89 has the ram 90 at the forward end thereof attached to the center of the lateral push bar 102. When the ram is extended, the push bar and the rearward ends 101 of the lift arms 68 are translated forward along the retaining channels 97 in the flanges of the frame, and the forward ends 69 of the lift arms are thereby raised (in scissor-like fashion with connecting arms 104).

As previously discussed in reference to the jack stand 12, the lift arms 68 have a pair of frusta-conical discs 70 pivotally attached (through suitable bushings and axels) on the inner sides of the forward ends 69 thereof. The discs provide for lateral self-centering and longitudinal self-aligning engagement with the angled inner surfaces 72 of the lower ends of the side flanges of the lifting plate 25 of the jack stand.

The forward ends 69 of the lift arm 68 have also a pair of leveling pads 110 acting in parallel and are pivotally attached to the outer sides thereof (through suitable bushings and fasteners co-axel with the discs 70), for providing a level platform thereon for supporting the lift bridge 14. Each leveling pad includes a vertical rectangular plate having a first lever arm 112 extending downward and forwardly at an angle from the plate, and with the plate having an upper flange 114 extending horizontally therefrom, providing a level platform thereon. The horizontal flange has a vertical aperture 115 therein for retaining the lift bridge. The platform has another flange extending vertically downward and forwardly therefrom forming a second parallel lever arm 116 thereon. The first and second lever arms having mating lateral apertures 117 in the forward ends thereof.

The leveling pads 110 utilize a pair of leveling links 118 that have a forward end 120 connected to the apertures 117 at the forward ends of the lever arms, and have a rearward end 122 connected to a point (at 122) on the connecting arm 104; so that as the forward ends of lift arms 68 are raised and lowered, the platforms formed by the upper flanges 114 of the leveling pads are maintained in a substantially horizontal orientation. The leveling pads, with the double lever arms and leveling links, provide a strong, rugged level platform for use with the lift bridge 14 to be discussed later in detail.

Figure 14:
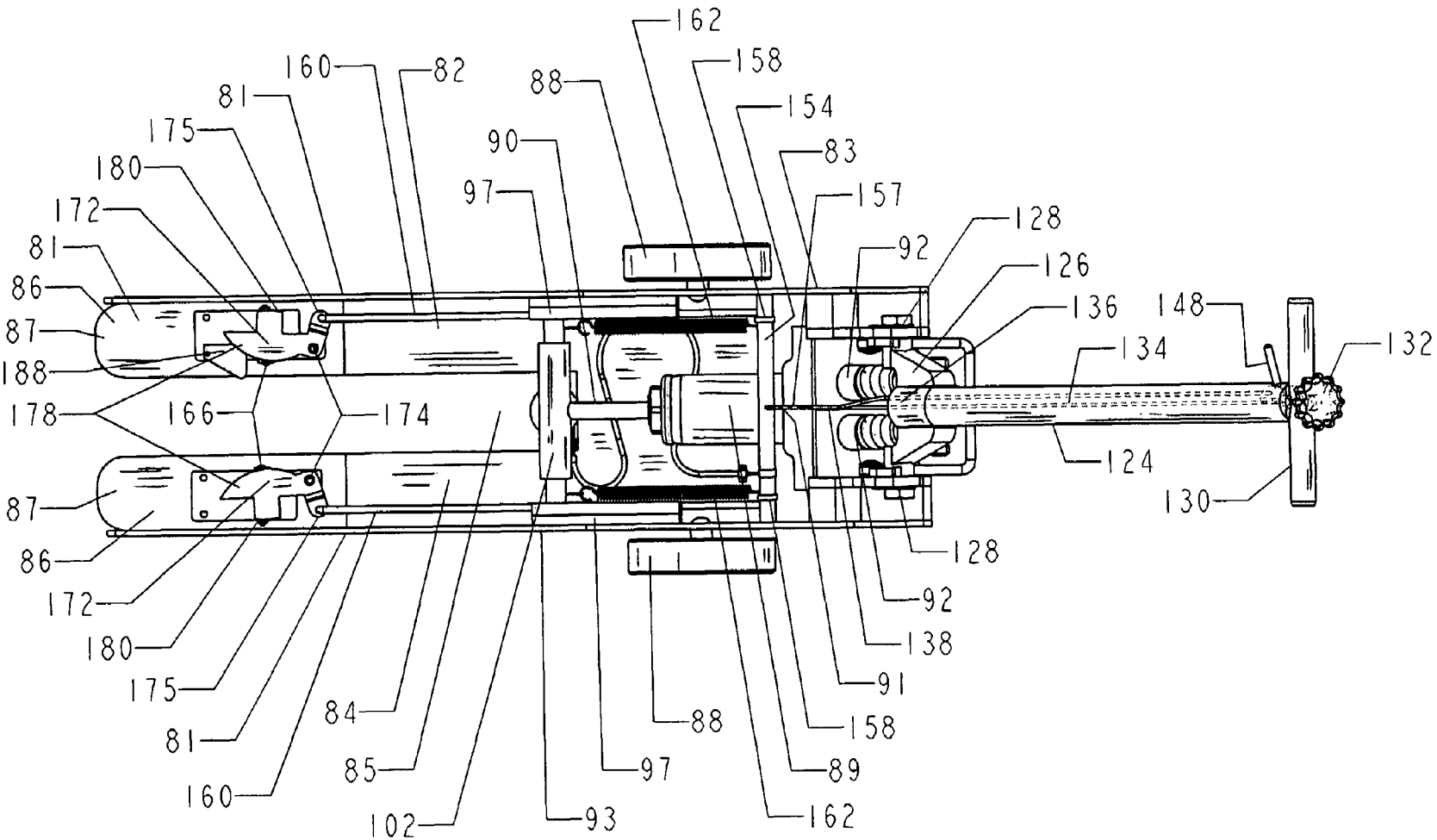
FIG. 14 is a top plan view of the power unit showing some of the control mechanism.
Figure 15:
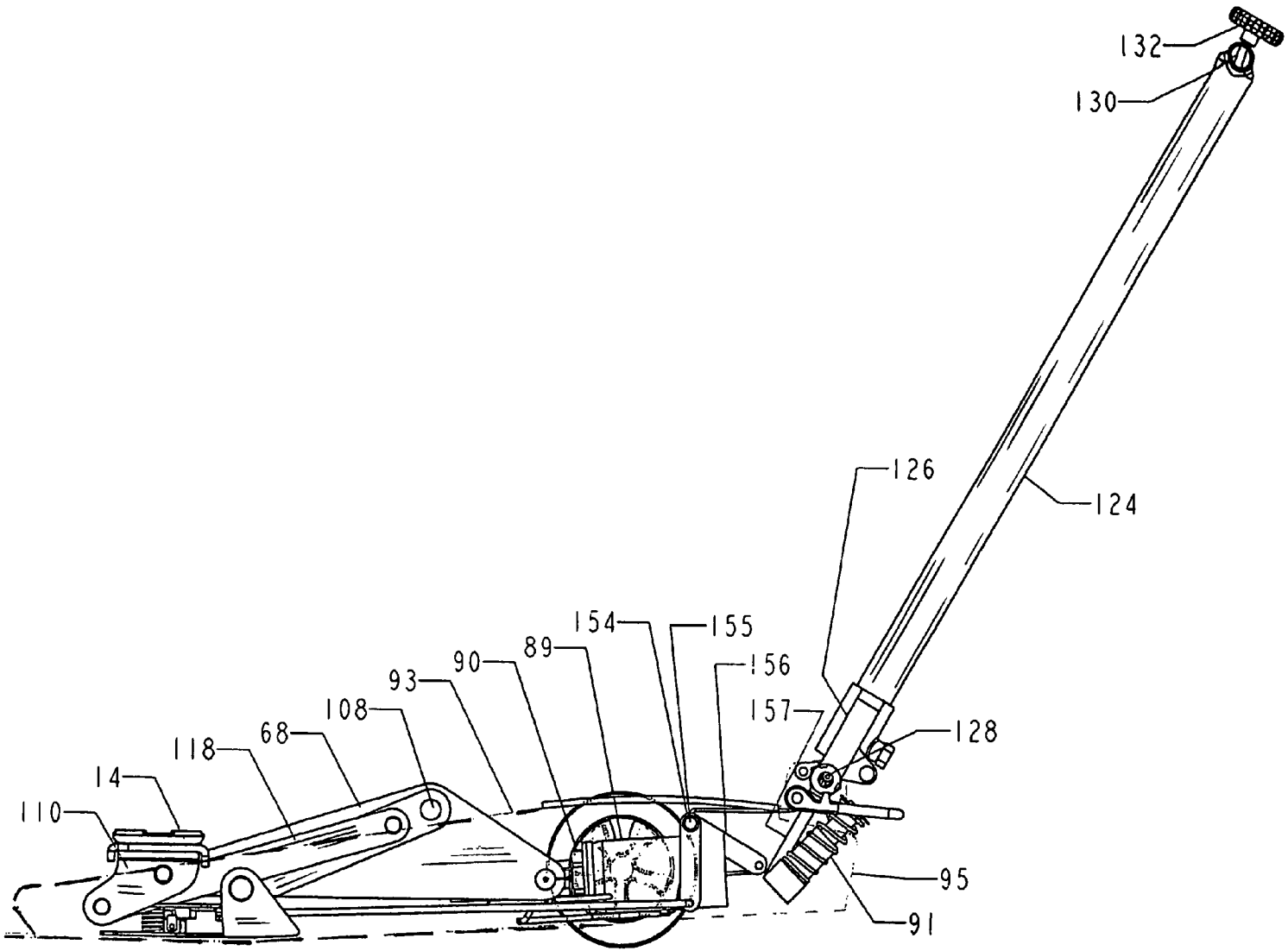
FIG. 15 is a side elevational view of the power unit in the lowest position.
Figure 16:
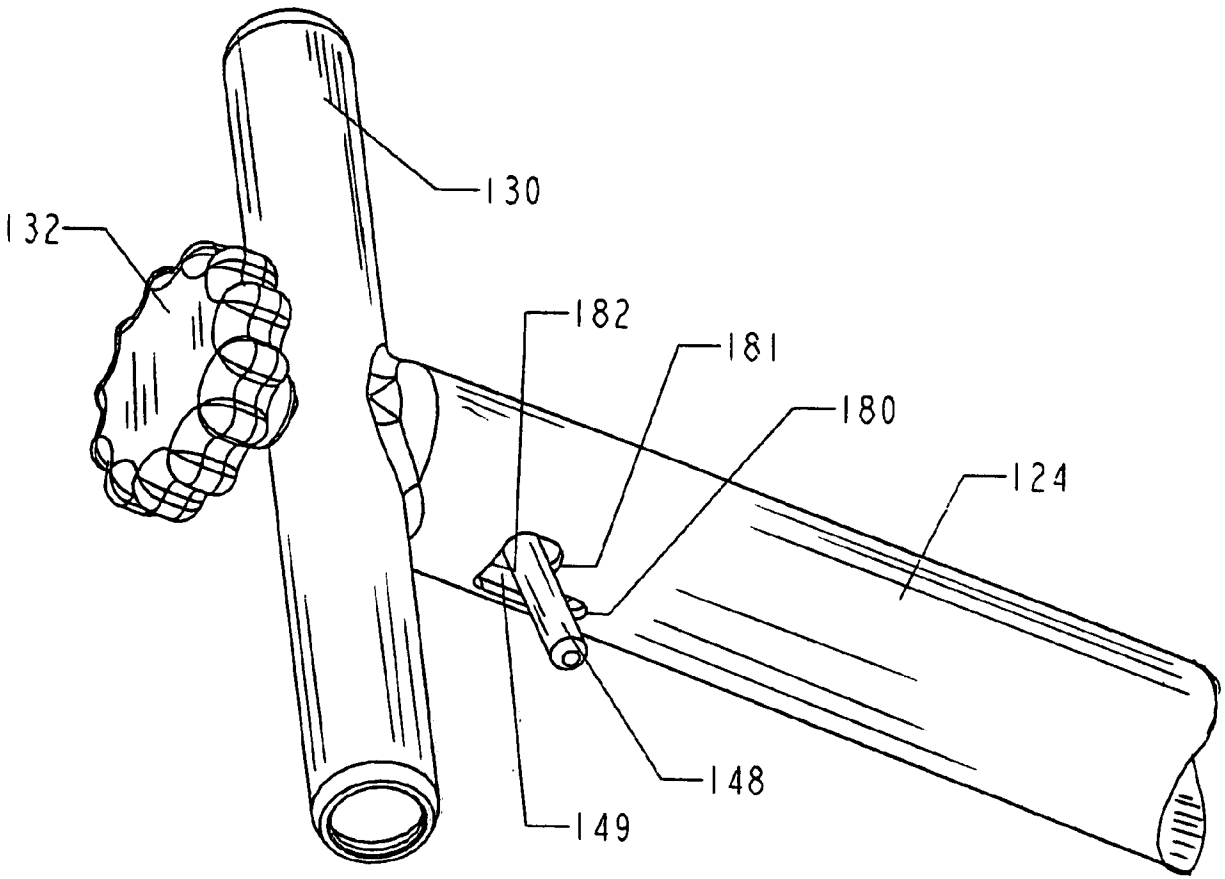
FIG. 16 is a top front perspective view of the upper end of the handle of the power unit.
Figure 21:
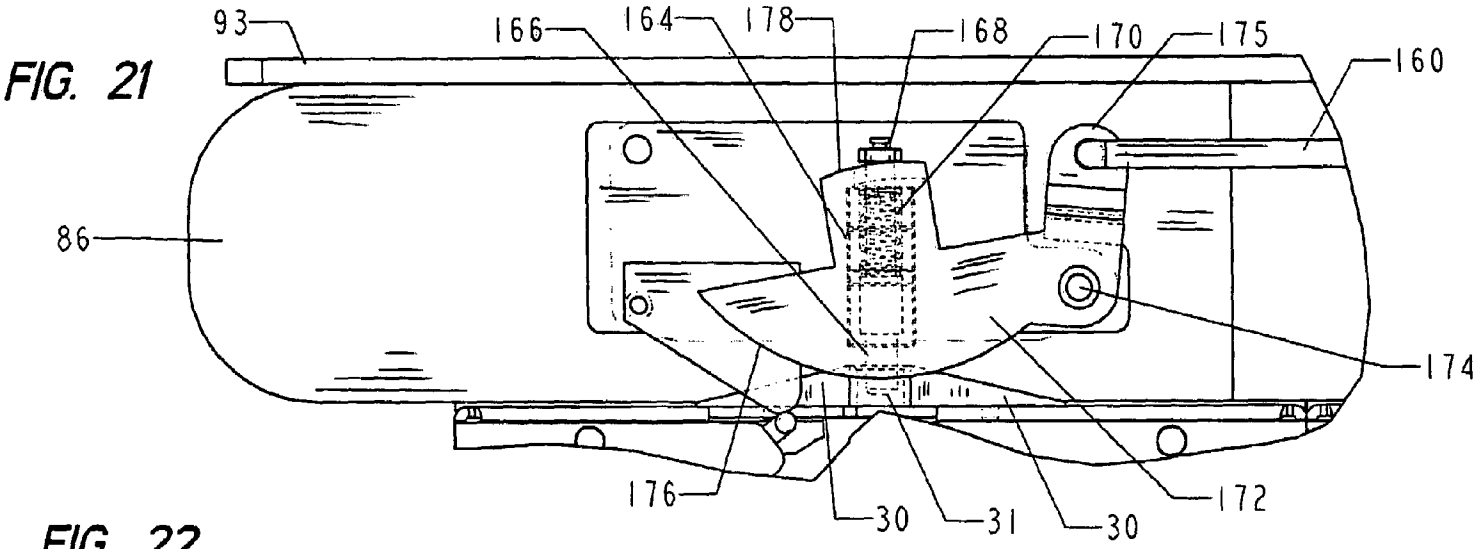
FIG. 21 is a sectional plan view of the right hand side of the power unit and jack stand of FIG. 2, showing the first position of the flipper control mechanism as seen from above.
Figure 22:
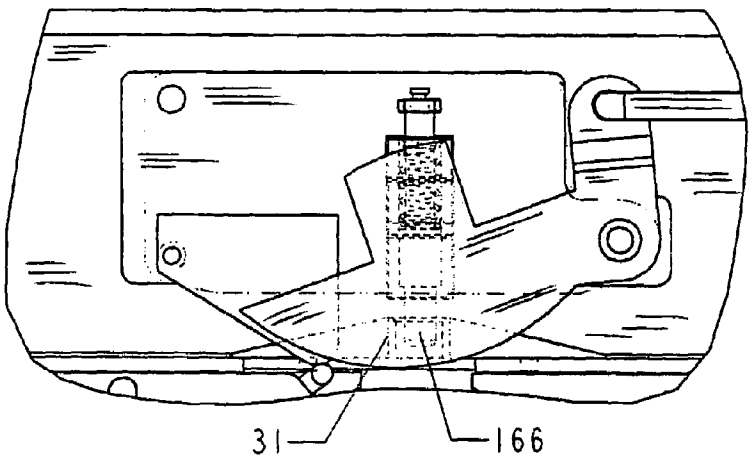
FIG. 22 is a view similar to FIG. 21 showing the second position of the controls.
Figure 23:
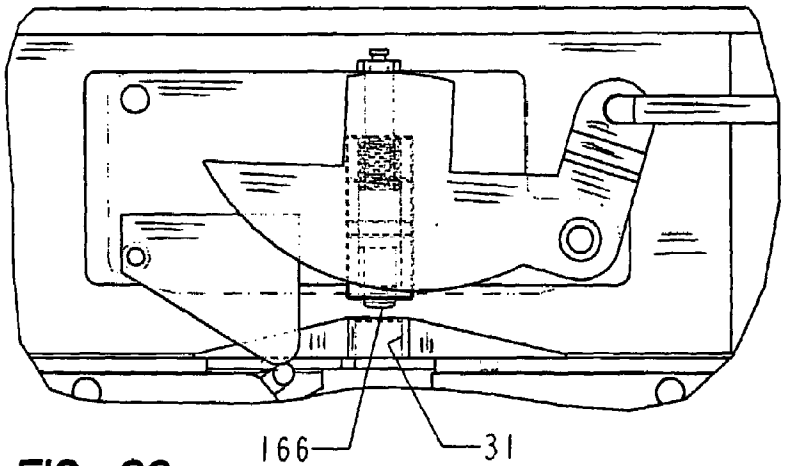
FIG. 23 is a view similar to FIG. 21 showing the third position of the controls.

Robust Commercial Power Unit—Controls for Aligning and Operating the Jack Stands Referring also to FIGS. 14 and 15, a tubular operating handle 124 is shown that typically extends rearwardly and upwardly from the rearward end 83 of the frame of the power unit 10. The operating handle is used in conventional fashion for maneuvering the power unit about on its wheels, to be pumped up and down for providing energy to actuate the hydraulic cylinder 89; and also for controlling the inter-engagement and the cooperative action of the power unit and the jack stand 12.

The rearward end 83 of the frame further includes a reinforcing rear bracket 125 that further supports the hydraulic cylinder 89, control valve 91, the actuator pistons 92 and includes a pair of handle flanges 127. The handle flanges are inboard about an inch from the side flanges 93 of the frame and extend upward from the bottom of the frame to above the pivot point of the tubular handle. The bracket supports the tubular handle and all of the mechanism for controlling the angle and position of the tubular handle.

The tubular handle 124 has a yoke 126 at the distal end thereof with lateral axels 128 thereon pivotally attached to the sides of the handle flanges 127 with suitable bushings and fasteners. The tubular handle has a "T-bar" hand grip 130 transversely attached to the proximal end thereof; and further has a rotatable control knob 132 extending through the hand grip for controlling the locking and releasing of the control valve 91 on the hydraulic cylinder 89. The control knob is fixedly attached to a rotatable control shaft 134 that extends through the tubular handle with the distal end thereof connected to a universal joint 136 so that the center of the u-joint is precisely between the lateral axels 128; and the other end of the u-joint is interconnected through a suitable coupling shaft 138 to the rotatable control valve 91 on the hydraulic cylinder (see also FIG. 24).

The u-joint 136 connected precisely between the lateral axels 128 allows the control shaft to freely pivot up and down, and to be folded over through a 180° arc, about the axels with the pivotal movement of the handle. The control knob is rotatable for locking the control valve of the hydraulic cylinder (with clockwise rotation) when needed, and for releasing hydraulic pressure inside the cylinder (with counter-clockwise rotation) when the pressure is no longer needed.

Figure 24:
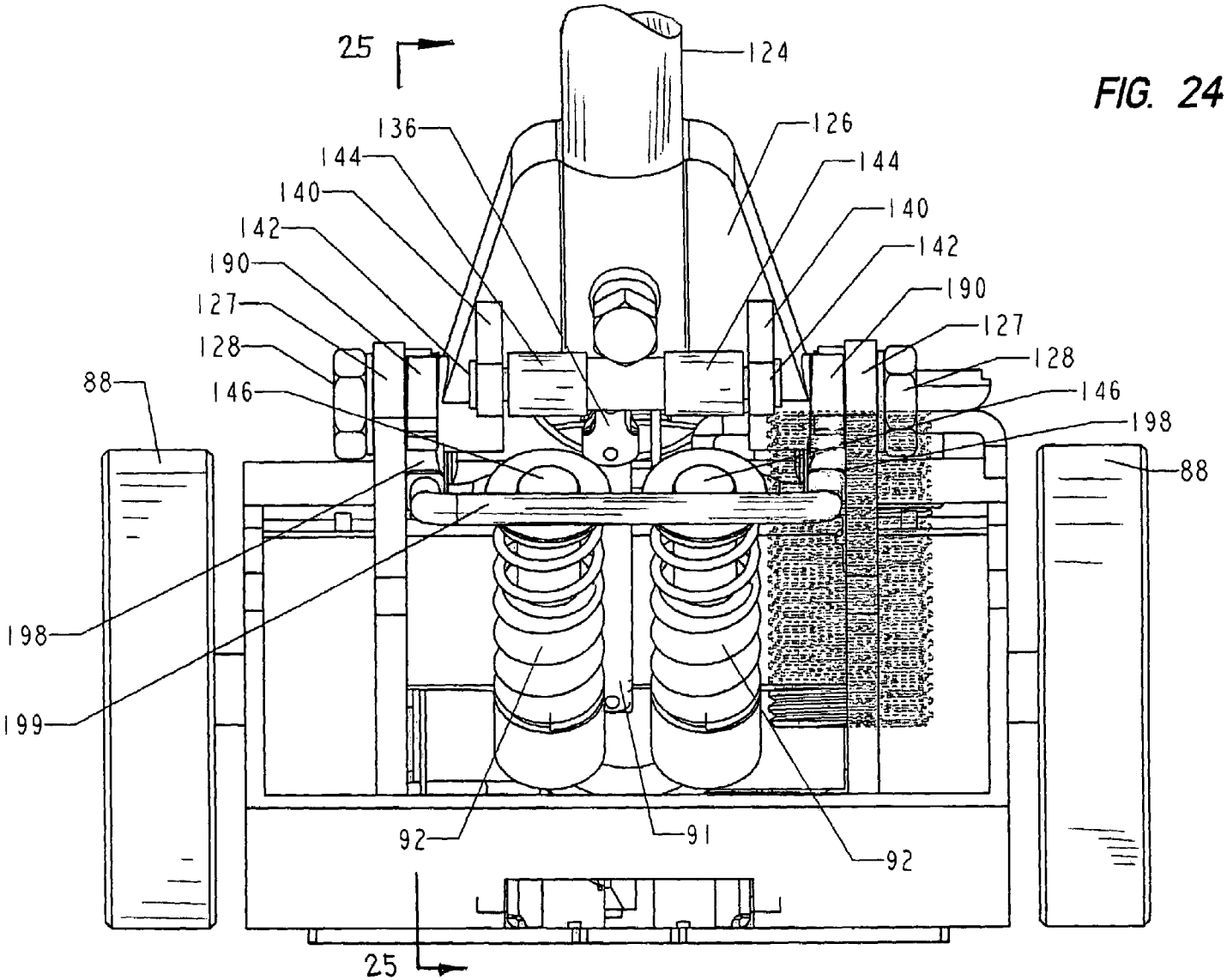
FIG. 24 is a rear elevational view of the power unit, showing the nesting of the bridge into the cover, and showing the cammed axel and foot lever for controlling the angle of the handle.
Figure 28:
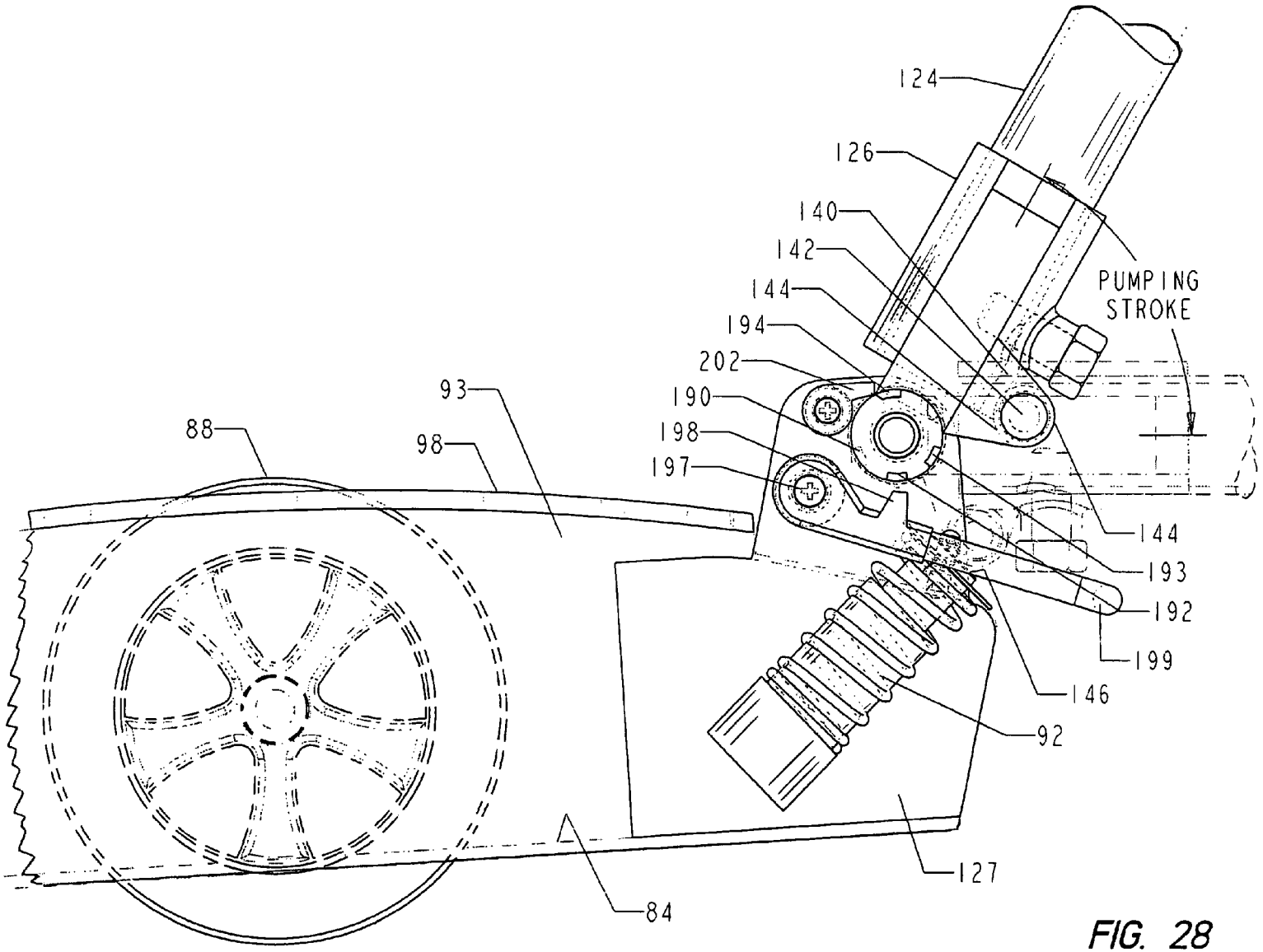
FIG. 28 is a view similar to FIG. 25 showing the handle unlocked and positioned to pump the hydraulic cylinder to elevate the lift arms of the power unit.

Referring also to FIGS. 24 and 28, the yoke 126 at the distal end of the handle 124 further includes a pair of flanges 140 extending rearward therefrom and supporting an axel 142 having a pair of cylindrical cams 144 thereon. The cams are positioned to contact the upper ends 146 of the dual piston actuators 92, and to pump the actuators with each downward stroke of the handle to extend the ram 90 of the cylinder. As previously discussed, both piston actuators are engaged by the cams; however one has a larger diameter for quickly advancing the ram with only a few strokes of the handle, but this piston can exert very little force; then, when the load is encountered, the other piston takes over to lift the load in the conventional manner. This allows the power unit to efficiently take up any initial space between the lift arms and the load.

Referring particularly to FIGS. 14-23, the tubular handle 124 has a control lever 148 extending through an opening 149 on the right side thereof and into an attachment member 152 that is slidably disposed within the tubular handle. The control lever is readily within the grasp of an operator having his right hand on the T bar hand grip 130. The control lever controls the engagement; inter-engagement and disengagement of the jack stand 12 carried within the frame of the power unit 10.

A control rod 150 has its proximal end secured to the attachment member 152 and extends (along the right side, adjacent to and parallel with the control shaft 134) from the control lever 148 to the distal end of the tubular handle. The control rod also includes a second universal joint 153 at the distal end thereof and between the lateral axels 128, so that the control rod can pivot with any pivotal movement of the handle, even 180° to fold the handle over the power unit.

Near the distal end of the handle 124, and within the rearward end 83 of the frame of the power unit 10, a transversely extending actuator or torsion tube 154 serves to transmit the action of the control lever 148 to the forward end of the power unit 10. Specifically, the torsion tube is supported on a transverse rod 155 whose ends are fixedly secured in the corresponding side flanges 93 of the rearward end of the frame. An actuator arm 156 acts as a lever, having one end rigidly attached to the torsion tube at the horizontal center thereof; while its otherwise free end is connected, through a coupling rod 157, to the other end of the second u-joint 153 at the distal end of the control rod 150.

Also, rigidly attached to the torsion tube 154, but near its lateral ends, is a pair of pull arms 158 which also act as levers. Each of the pull arms has one end fixedly attached to the torsion tube, and the outer end attached to the rearward end of an operating rod 160. Each operating rod has its rearward end (bent at a right angle) pivotally attached to an eye or opening in the lower end of the associated pull arm 158. On the inner part of the rearward end of each operating rod, a tension spring 162 is attached, and each spring is secured (by a suitable hook thereon) to the bottom of the frame. The springs tend to pull the control rod 150 downward, away from the hand grip 130.

The operating rods 160 control the inter-engagement of the associated control mechanisms with the corresponding side of the jack stand 12. Because of the springs 162, each operating rod is normally urged toward the forward end of the power unit 10, i.e. toward the forward end of the corresponding frame extension 86.

A portion of the control mechanism has been described as part of the jack stand 12. Thus, the lower ends 40 of the ratchet arms 36 stands ready to release the corresponding upper pawl 37 from the particular ratchet teeth with which it may then be engaged (when also there is insufficient vertical stress of the jack stand 12 to keep the pawl engaged). Also, the alignment holes 31, located in the longitudinal center of the ramps 30 of the jack stands, are available to assist in providing a locking action whenever a position of alignment has been reached within the power unit 10.

In the power unit 10, each forward extension 86 of the frame has a generally inner horizontal part, and an outer vertical part provided by the side flanges 93. An alignment pin block 164 is attached to the horizontal portion of each forward extension. An alignment pin 166 is supported within each corresponding pin block, extending horizontally in a direction transverse to the longitudinal axis of the frame of the power unit 10. A pin tab 168 is attached to the outermost end of each pin (near, but spaced away from the vertical side flange), and a (compression) pin spring 170 housed inside the pin block urges each alignment pin in the forward direction, i.e. toward the lateral center of the frame. The movement of the alignment pins 166 in the direction towards or away from the lateral center of the frame, is controlled by the action of the control lever 148, acting through the control rod 150, and the operating rods 160 and a pair of generally rectangular shaped flippers 172.

Each of the pair of flippers 172 is pivotally mounted at its inward rearward corner upon a fixed vertical post 174 that extends upward from the horizontal frame extensions 86. Each flipper is also pivotally coupled, at its outward rearward corner 175, directly to the associated operating rod 160, and the flipper acts as a lever arm (see FIG. 21). The movement of the operating rods controls the movements of the flippers, and the movement of the flippers in turn controls the movement of both the associated alignment pins 166 and the associated ratchet release arms lower ends 40.

More specifically, each flipper 172 has an arcuate inner edge 176 which is selectively engageable with the associated ratchet arm lower end 40. On its outer edge, the flipper has a downwardly extending tab 178 at the center thereof which fits inside the pin tab 168 of the associated alignment pin 166. When the flipper is moved horizontally to its extreme inward position (see FIG. 22) it pushes ratchet release end 40 inward, and at the same time alignment pin 166 is free to be urged into its innermost position by its spring 170. When the flipper is moved horizontally towards its extreme outward position (see FIG. 23), it first disengages from the ratchet arm lower end 40, and subsequently forces the pin tab 168 toward the outer wall of the associated frame extension 86 thereby withdrawing the alignment pin 166 away from any engagement with the aligning hole 31 of the jack stand 12.

Referring particularly to FIGS. 16-20, The control lever 148 extends through the opening 149 in the right side of handle 124, the opening being somewhat P-shaped in that it has a lower notch 180, another separate intermediate notch 181, and has an upper end edge 182.

If lever 148 is positioned by the operator to drop into the lower notch 180 (see FIGS. 17 and 22), then operating rods 160 assume their most forward positions, and the downward tabs 178 of the flippers 172 position the alignment pins 166 inward; and the inner edge 176 of the flippers press the lower arms 40 of the ratchet release arms 36 inward. In this position, the pawls 37 cannot engage the ratchet teeth 32, 42 of the second or third frames of the jack stands 12. This is the typical position of the control lever when the power unit 10 is used to load a jack stand 12 into the frame thereof.

When control lever 148 is pulled back toward hand grip 130 by the operator and then positioned to rest in the intermediate notch 181 of opening 149 (see FIGS. 18 and 21) the locking pins 166 lock the power unit 10 to the jack stand 12, but the inner edges 176 of the flippers 172 do not press the lower ends 40 of the ratchet release arms 36 inward, and thus the pawls 37 of the ratchet arms are engagable with the respective teeth 32, 42 of the frames 22, 23 of the jack stand. This is the typical position of the control lever to raise the jack stand to lift the load, and will be discussed later in more detail.

The third position of the control lever 148 is used to release the power unit 10 from the jack stand 12. The operator pulls the control lever to its uppermost position 182 in the opening 149 (see FIGS. 19 and 23). The alignment pins 166 are withdrawn from the alignment holes 31 of the jack stand, and the inner edges 176 flippers do not press the lower ends 40 of the ratchet release arms 36 inward. This is the typical position of the control lever so that the power unit 10 can be pulled in the longitudinal direction for disengaging it from the jack stand 12.

To lift a load with the jack stand 12, the power unit 10 will first have been used to pick up the jack stand from a previous location, align and lock it within the frame of the power unit, and transport it with the hand grip 130 of the handle 124 to the location where it is to be used.

When the jack stand is in the proper location with the bottom plate 27 securely resting upon the floor or other supporting surface, the operator rotates the control knob 132 (in the clockwise direction) to lock the pressure valve of the hydraulic cylinder 89. The operator positions the control lever 148 in the intermediate notch 181 of opening 149 of the handle 124. The operator then pumps the handle up and down to energize the hydraulic cylinder to raise the forward ends of the lift arms 68 under the lifting plate 27 of the jack stand, to lift the load. The pawls 37 of the ratchet arms 36 engage successive ratchet teeth 32, 42 of the tubular frames 23, 33 as the jack stand is raised to the desired elevation.

When the load has been raised to the desired elevation, the pumping of the handle is naturally discontinued. The control knob 132 on the handle 129 is rotated (in the counter-clockwise direction) to release the pressure in the hydraulic cylinder, and the lift arms 68 will drop down into the frame, leaving the load supported solely by the extended tubular frames of the jack stand, locked in position by the pawls 37 of the ratchet arms 36. The control lever 148 is then pulled upward to the edge 182 of the opening 149 in the handle, for releasing the aligning pins 166 of the power unit from the jack stand, and the power unit can then be disengaged from the jack stand, leaving the load mechanically supported solely by the jack stand.

When the load is to be lowered, the control lever 148 is placed in the lower notch 180, and the power unit 10 is aligned with and locked to base assembly 26 of the elevated jack stand 12. The control knob 132 is locked and the operator pumps the handle to raise the lift arms upward and under the lifting plate of the jack stand. The operator then positions the control lever to rest in the intermediate notch, 181. At this time the lateral edges 176 of flippers 172 are pressing inward against the respective lower ends 40 the release arms 36. However, the pawls 37 do not then release, because the configuration of the ratchet teeth and the weight of the vertical load on the respective frame combine to wedge the pawls into the ratchet teeth, and prevent the disengagement of the pawls.

The next step to lower the load is to utilize the handle 124 to extend the lift arms 68 to raise the lifting plate 27 at least a slight amount. This action relieves the vertical load on the ratchet teeth so that the flippers can then press the lower ends 40 of the ratchet arms 36 inward, thereby permitting the pawls 37 to disengage from the ratchet teeth. The operator then slowly rotates the control knob (counter-clockwise) to release the hydraulic pressure and thus the lift arms 68, and the extended tubular frames of the jack stand 12 descend and telescope into each other, allowing the load to be lowered.

The simple T bar hand grip 130 with the central control knob 132 and the right side control lever 148 are very straight forward for the operator to quickly understand, and are very simple to operate. An operator can load a jack stand 12 into the power unit 10, position the jack stand, raise the jack stand, and finally lower the jack stand, all with only the need to use one hand to control the hand grip, position the control knob and position the control lever.

Figure 12:
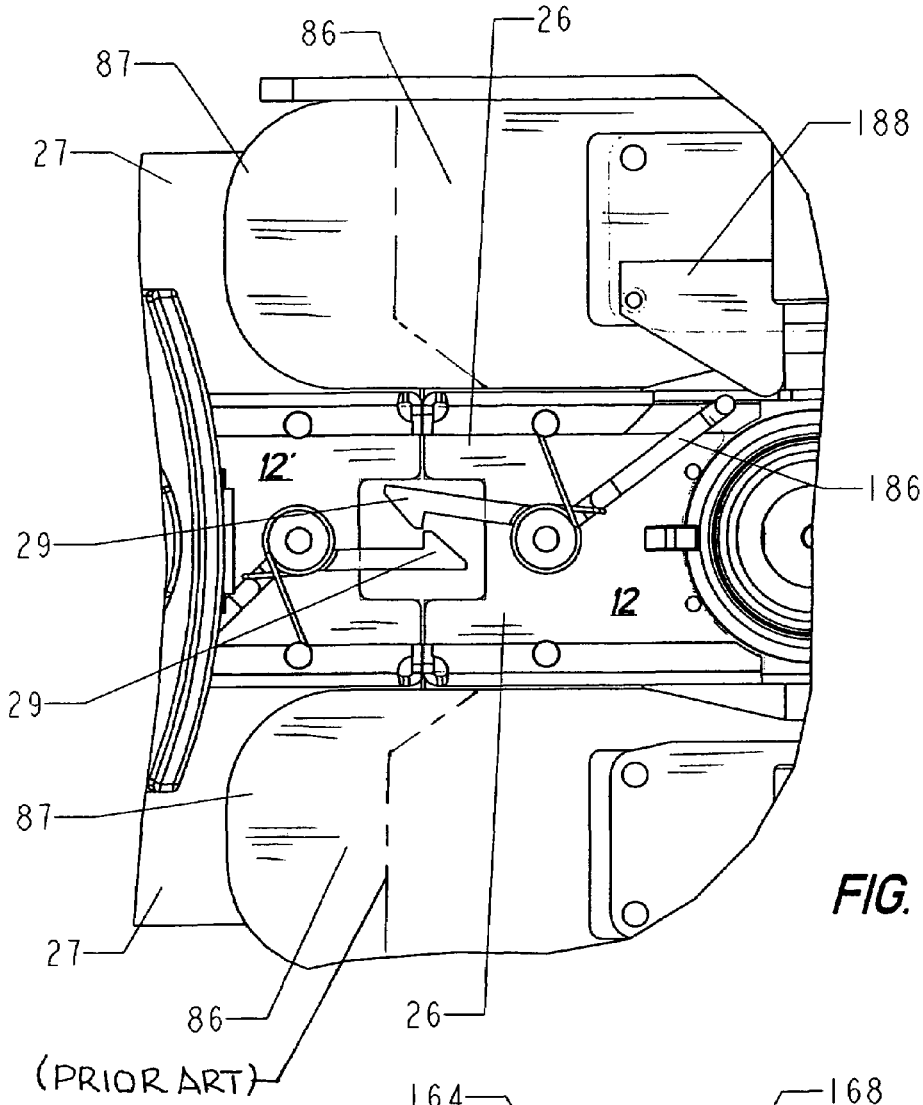
FIG. 12 is a fragmentary plan view of the base assembly of the jack stands.
Figure 13:
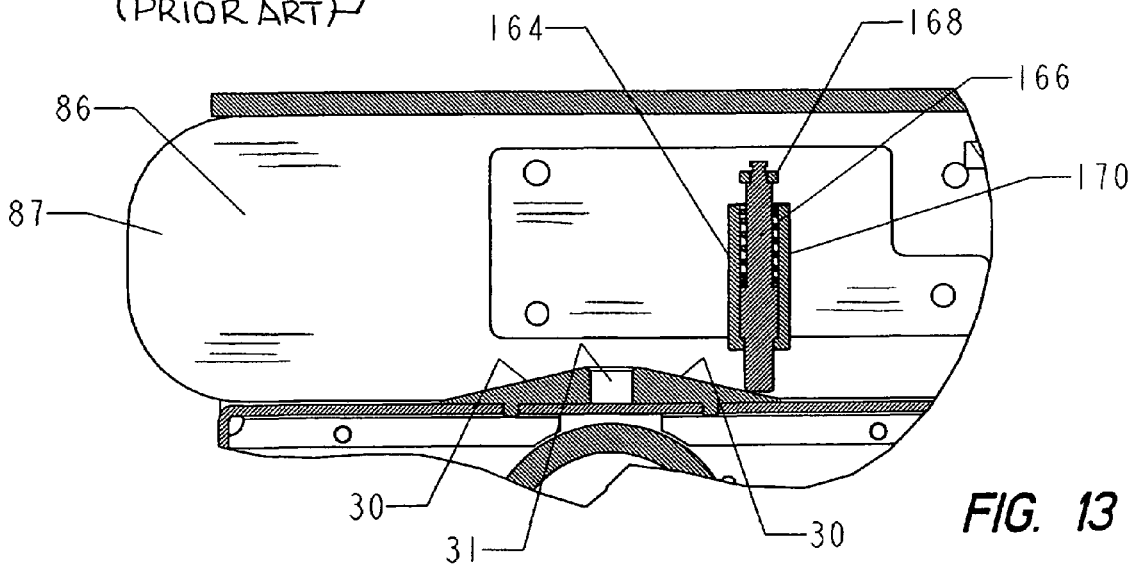
FIG. 13 is a fragmentary plan view of one side of the jack stand and one side of the power unit, showing the locking pin on the power unit and the ramp on the side rail of the jack stand.

Referring also to FIGS. 12 and 13, as described in detail in earlier patents by the present inventor, when two or more of the jack stands 12, 12' etc., are placed adjacent to each other in a longitudinal series, the latch fingers 29 on the front end of one jack stand becomes hooked with the similar latch finger on the rearward end of the other jack stand. However, pivotal inward movement of a release arms 186, by a tripper 188 will automatically cause the two latch fingers to become disengaged, thus permitting the two jack stands to be separated. This feature is also utilized in the present invention.

Briefly, when a first jack stand is picked up by the power unit, the frame extensions 86 of the power unit are simply moved past the opposing sides of the base assembly 26 of the jack stand, above bottom plate 27 but below ramps 30, until alignment pins 166 of the power unit lock into the respective alignment holes 31 in the ramps of the jack stand. If a second jack stand is to be picked up for transport, the operator then moves the control lever 148 into its full disengagement position at upper edge 182 of opening 149 (see FIGS. 19 and 23) to release the aligning pins. Using the handle 124, the operator then pushes the power unit further forward so that the frame extensions pick up the next jack stand; again, by entering the vertical space between bottom plate 27 and side ramps 30. The power unit is pushed forward until alignment pins 166 lock with the holes 31 in the second jack stand, and the latch fingers 29 are automatically hooked together.

When two or more jack stands are thus being transported by the power unit, the forward jack stand is necessarily the one that will be positioned first for lifting a load. As previously discussed, after the jack stand is elevated, the power unit is lowered and pulled away. Since the first jack stand is hooked to the second jack stand, as the power unit is pulled away, the hooked latch fingers 29 pulls the second jack stand toward the front of the power unit. It is at this time that the latch release arm 186 on the jack stand cooperates with the tripper 188 on the power unit for unlatching the two stands. The tripping action occurs somewhat in advance of the location where the power unit becomes locked to the second jack stand. Thereafter, further rearward movement of the power unit relative to the second jack stand, results in it being aligned with and locked to the second jack stand.

The tripper 188 is located on frame extension 86 of the power unit slightly forwardly of the associated flipper 172. Its position is fixed relative to the frame extension, and it accomplishes its function not by its own movement, but by the longitudinal movement of the power unit relative to the jack stand. The tripper 188 is supported at an elevation above the horizontal frame extension 86, somewhat below the horizontal plane occupied by the flipper 172, and also at a slightly lower elevation than the top of the alignment pin block 164.

Commercial Power Unit—Controls for Positioning the Handle

Referring again to FIGS. 24 and 28, the handle 124 at the rearward end 83 of the frame of the power unit 10 is shown in its operative position to pump the actuator pistons 91 to extend the hydraulic cylinder 89. However, it is often desirable to lock the handle in a fixed position for maneuvering the power unit around the shop, and into confined spaces for the placement or retrieval of the jack stands 12, or for compactly shipping or storing the power unit. The control of the position of the handle is discussed in terms of the power unit 10, but such controls are also applicable for any conventional hydraulic floor jack.

The controls for positioning the handle 124 include a pair of generally cylindrical discs 190 that are oriented vertically and fixedly attached to the lateral ends of the yoke 126 of the handle, and are coaxial with the axels 128. Each of the discs has a diameter of about one inch and a thickness of about 0.25 inches and has a matching set of radial notches formed (at pre-determined angles, generally as shown) in the periphery thereof; specifically, a first notch 192, a second notch 193 and a third notch 194. The notches are about 0.13 inches deep with angled sides to an inner length of about 0.25 inches.

A pair of lever arms 196 acting in parallel each have one end 197 thereof pivotally attached to the handle flange frame 80, just below and adjacent to the notched disc 190; and extends generally tangentially to the notched disc 190. The lever arm has a lug 198 thereon projecting upwardly toward the periphery of the disc. The lever arm has a lever handle 199 extending beyond the rearward end 83 of the frame for readily pivoting the lever arm, preferably by the toe of the operator. The lever arm is pivoted upward so that the lug is engagable with a respective notch in the disc, to fix the position of the handle 124; or is pivoted downward to disengage the lug from any notch in the disc, so the handle 124 can pivot freely on the axels 128 of the power unit 10.

The pair of lever arms 196 is preferably in the form of a U-shaped bar of steel about 0.38 inches thick. The ends 197 are typically in the form of vertical eyelets attached to the frame with suitable bushings and fasteners. The lugs 198 are somewhat tapered and have a flat upper tip about 0.25 inches by 0.25 inches to readily fit within a respective notch of the disc 190. The base of the U-shaped bar provides a rugged lever handle 199 to synchronize the lugs within the disc and is readily operable by the toe of the operator. (The handle controls can function with only one notched disc 190 and only one lever arm 196, but it is preferable to have the balanced engagement provided with two discs and the U-shaped pair of lever arms.)

Figure 25:
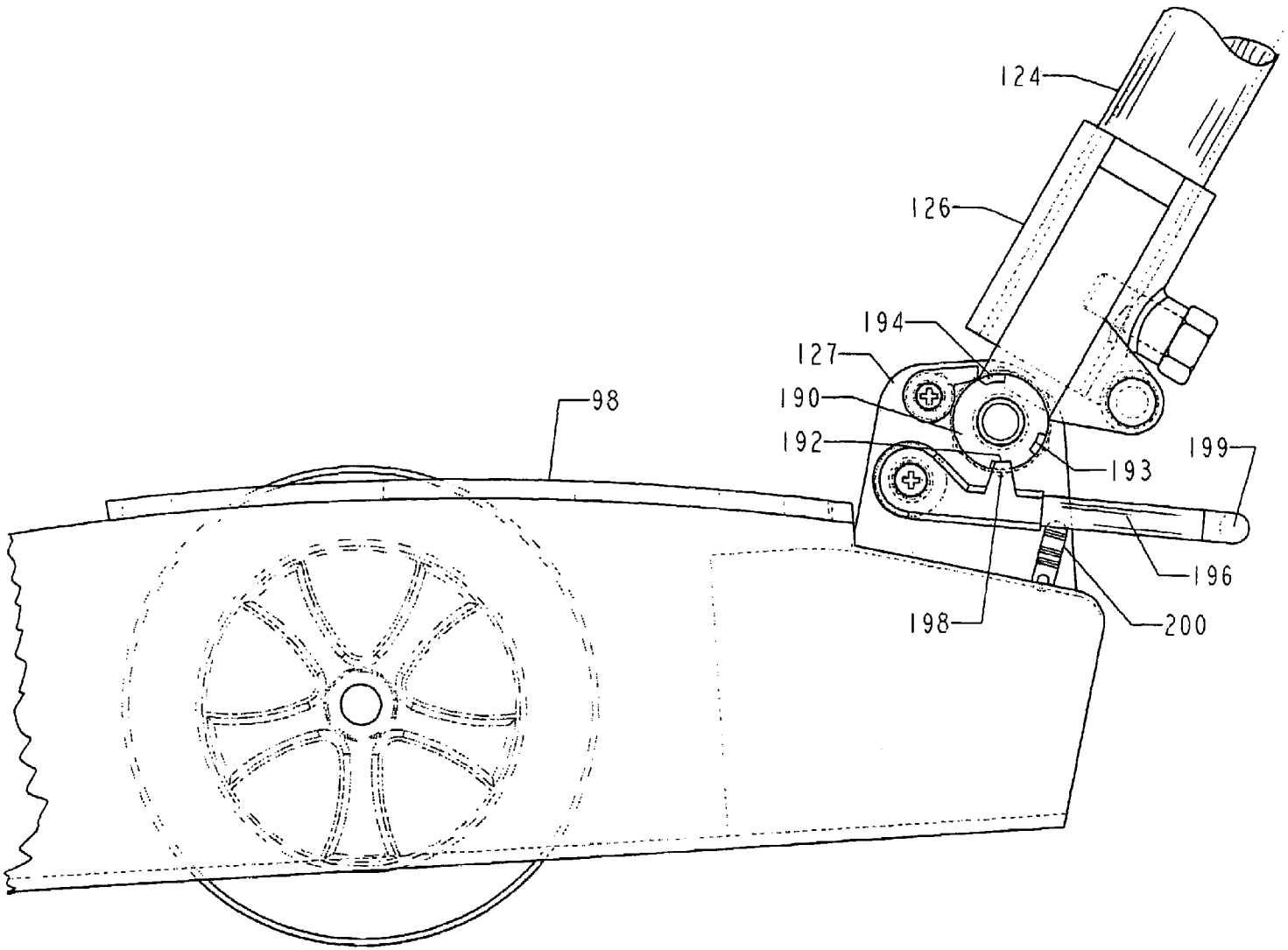
FIG. 25 is a fragmentary side elevational sectional view taken along 25-25 of FIG. 24 showing the handle locked at an acute angle for maneuvering the power unit.
Figure 26:
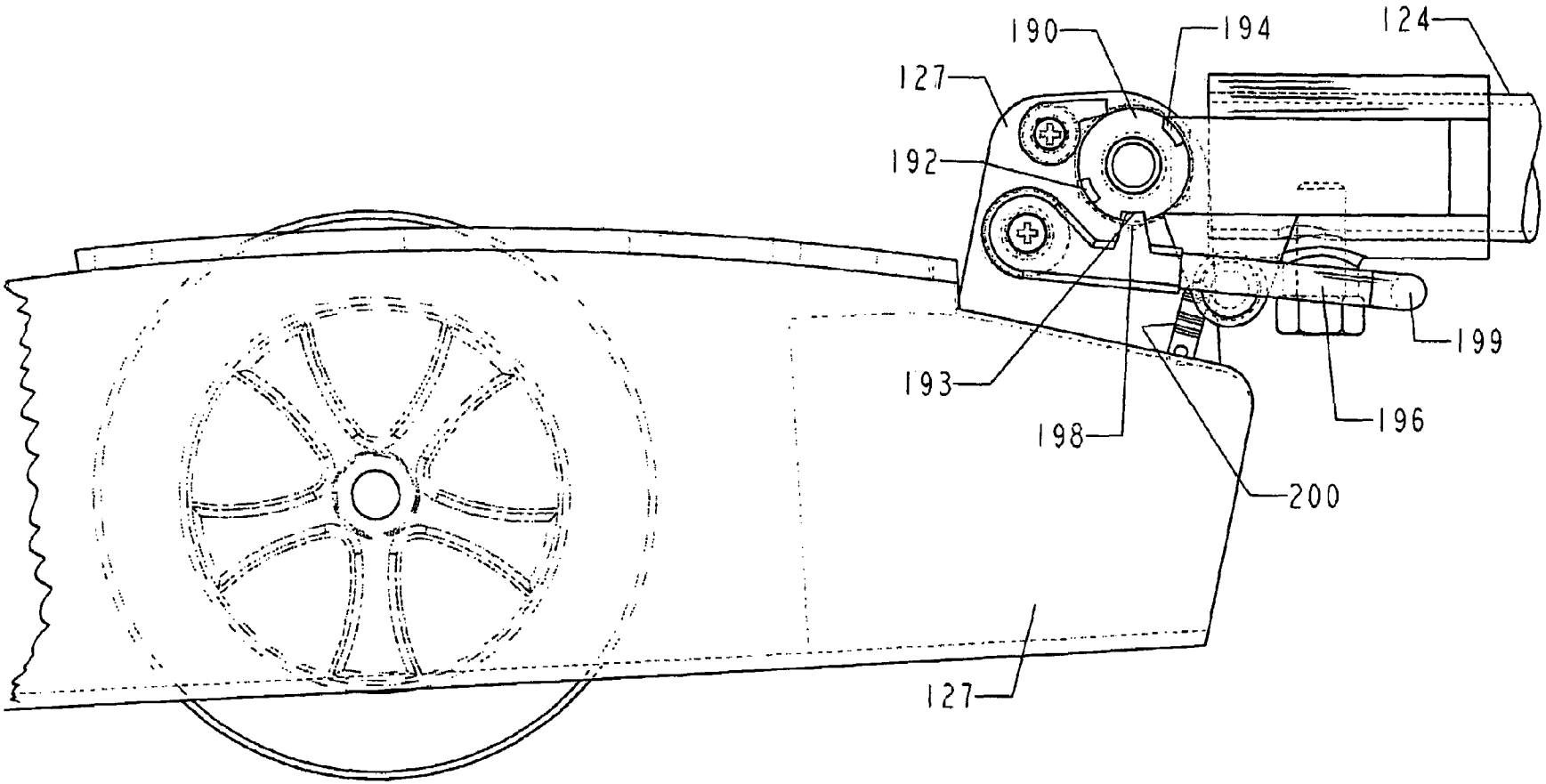
FIG. 26 is a view similar to FIG. 25 showing the handle locked at a flat angle.

The handle controls further includes at least one lever arm retaining clip 200 that is attached to the side of the frame adjacent to of the lever arms 196. The retaining clip is typically made of spring steel having a first detent position 201 for retaining the lever arm into the upward engageable position, and a second detent position for retaining the lever arm in the downward disengaged position Referring now to FIG. 25, the handle 124 is shown fixed in the normal upward angle (of about 60°) with the lug 198 of the lever arm 196 engaged in the first notch 192 of the notched disc 190. The lever arm is retained in this upward position by the retaining clip 200. In this fixed position, the handle can be readily pushed downward thereby raising the front end of the power unit about the rear wheels, for maneuvering and positioning the power unit into a desired location.

Referring again to FIG. 28, the handle 124 is shown released in the normal upwardly angled position with the lug 198 of the lever arm 196 in the downward position and disengaged with the notched disc 190. The lever arm is retained in this downward position by the retaining clip 200. In this position, the handle can be readily pumped up and down to actuate the actuators 92 of the hydraulic cylinder 89 to raise the lift arms of the power unit 10. The handle can also be folded over the power unit, as further discussed later.

The handle controls further includes a pawl 202 that is pivotally attached to the frame, slightly above and adjacent to at least one of the notched discs 190 so that the pawl is biased into light contact with the periphery of the notched disc. The pawl normally just rides smoothly on the disc as the handle 124 is pivoted and pumped, but it is provided to prevent the handle from falling forward over the power unit at an undesirable time (possibly into an auto or just forward requiring it to be retrieved). When the handle reaches the vertical position of about 90°, the third notch 194 is positioned so that the pawl engages the notch and prevents any further forward pivoting by the handle. The handle is free to be pulled backward, whereby the pawl is automatically released from the notch, and the handle remains free to pivot and pump within the 0° to 90° range.

Figure 27:
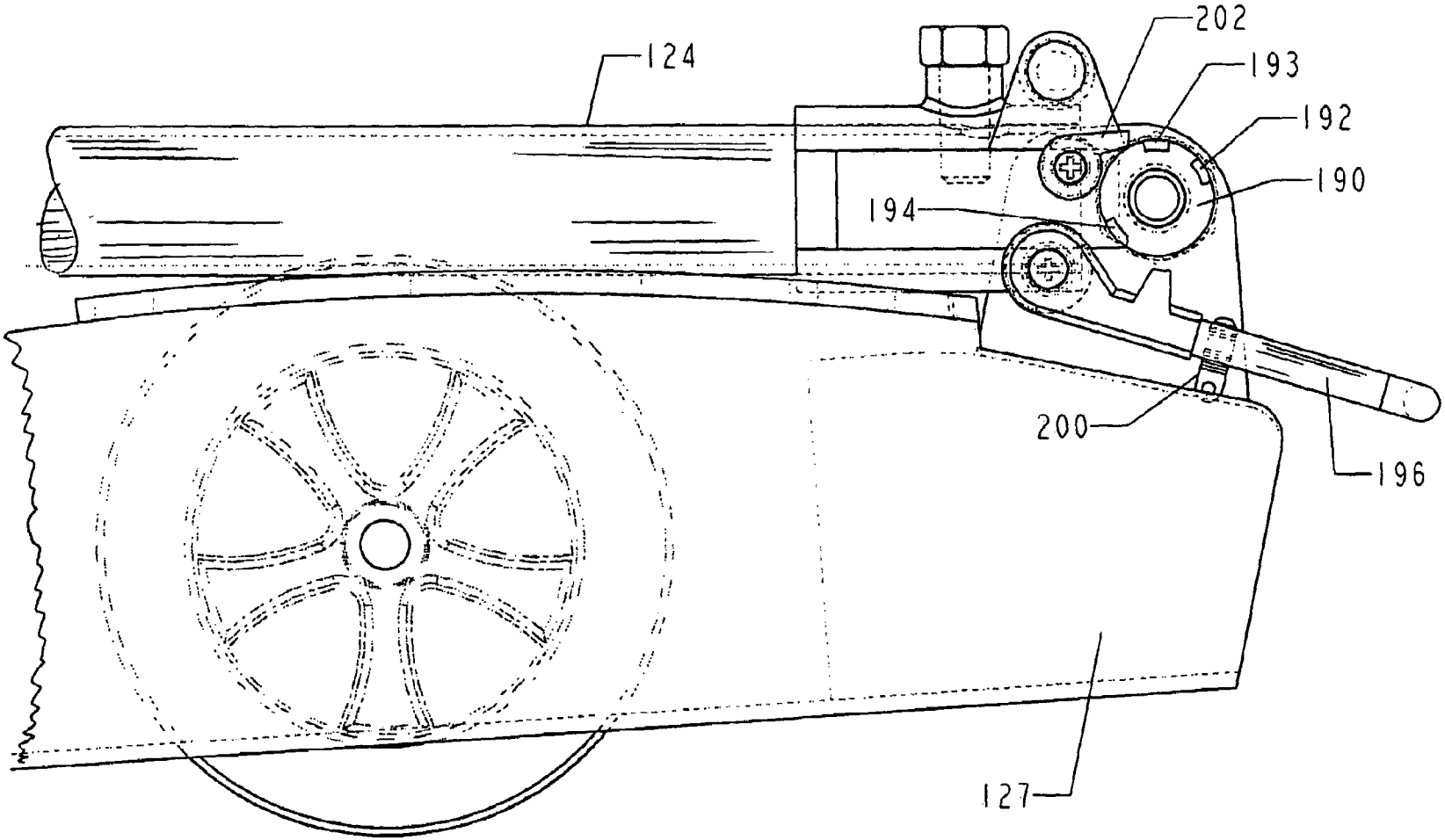
FIG. 27 is a view similar to FIG. 25 showing the handle unlocked and folded forward over the power unit, for compact shipping or storage.

Referring now to FIG. 27, the handle 124 is shown released and folded over (about 180°) onto the power unit with the lug 198 of the lever arm 196 disengaged from the notched disc 190. The lever arm is retained in this downward position by the retaining clip 200. To get to this folded over position, the handle is naturally pivoted forward; however, the pawl 202 will normally engage the third notch 193 at about 90° and prevent any further forward pivotal movement by the handle. It is necessary to manually lift the pawl from the notch (either flip it over, or just raise it while the handle is pivoted passed the third notch). In this folded over position, the power unit can be compactly shipped or stored (efficiently without the need for reassembly).

In the power unit 10, the folded over position of the handle 124 is facilitated by the u-joint connections of the control shaft 134 and the control rod 150 at the axel 128 of the handle, that permit these components to be folded over along with the handle.

Robust Commercial Power Unit—Two Position Bridge

Figure 29:
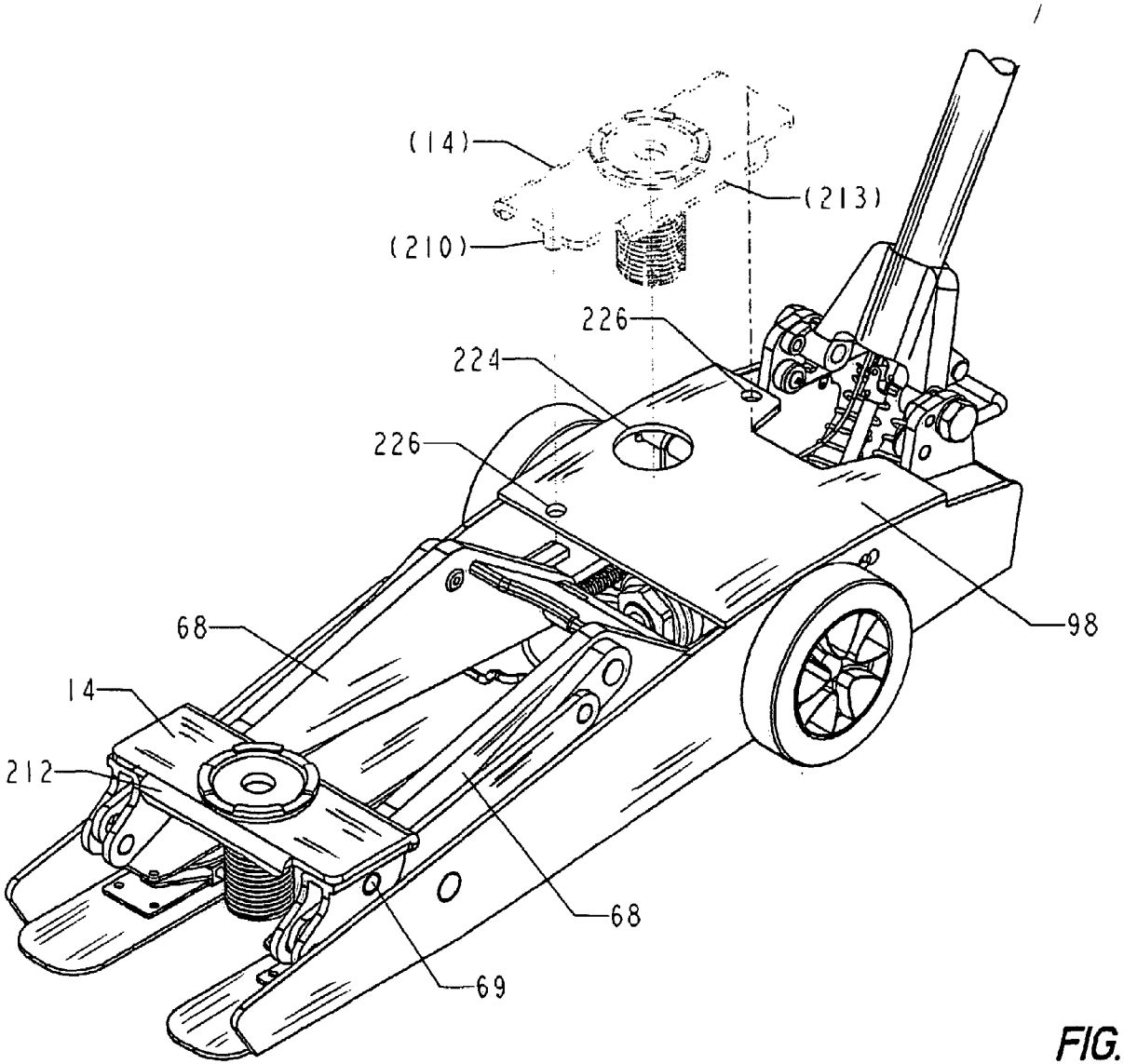
FIG. 29 is a top front perspective view of the power unit having the two-position bridge on the forward ends of the lift arms (with the second position of the bridge shown in phantom)
Figure 30:
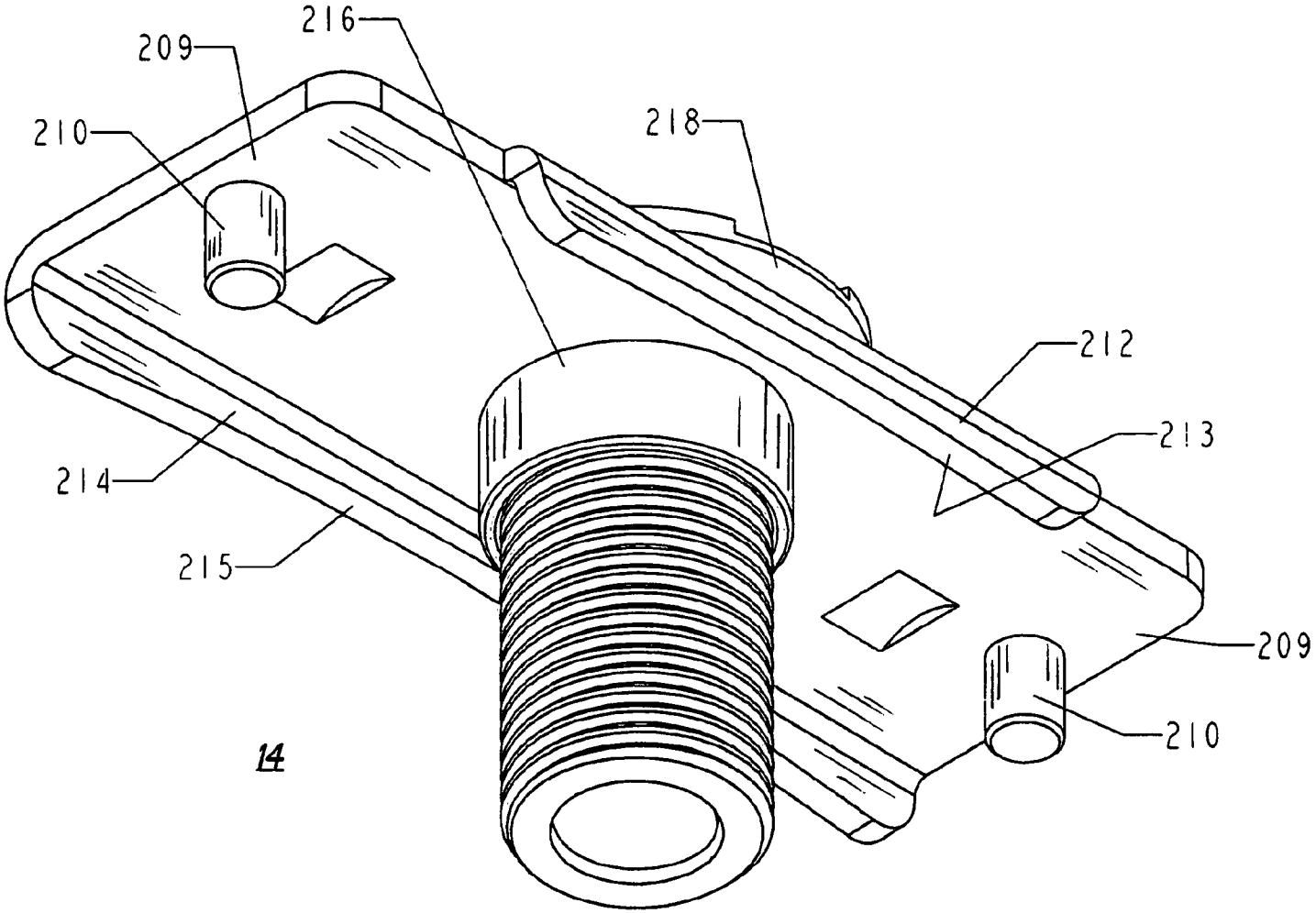
FIG. 30 is a bottom front perspective view of the two-position bridge with the compound-screw-out saddle down, and showing the engaging pins and the arcuate contour of the flanges.
Figure 31:
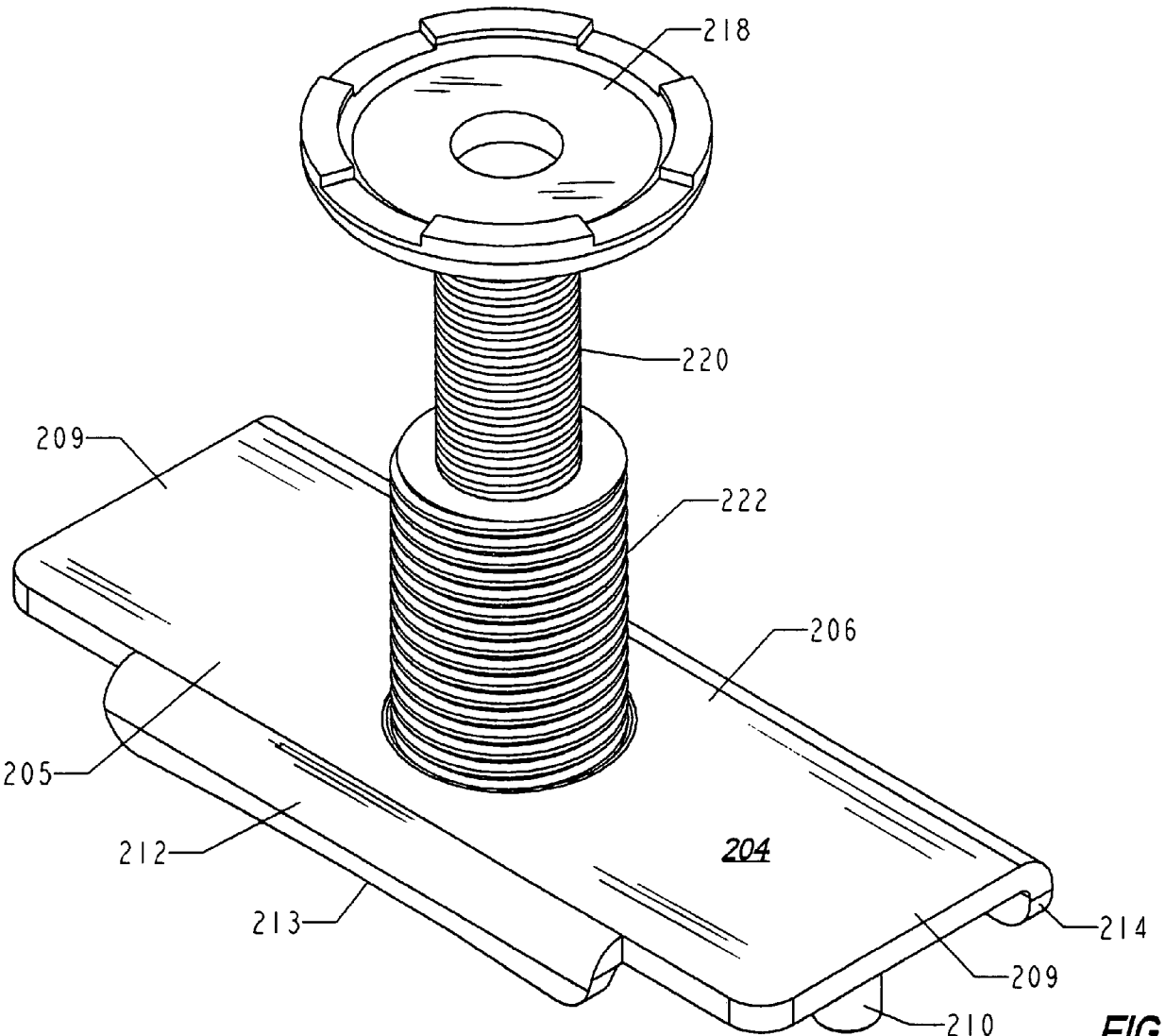
FIG. 31 is a top front perspective view of the two-position bridge with the compound-screw-out saddle in the highest configuration.

Referring now to FIGS. 29-31, the two-position lift bridge 14 is described in more detail. The lift bridge is utilized to "bridge" the otherwise open span between the forward ends 69 of the lift arms 68 of the power unit, so that the power unit can function as a conventional floor jack for directly lifting a load. The two position bridge refers to the lift bridge being stored in one position on the rear cover of the power unit, as shown in phantom in FIG. 29 (see also FIG. 1), and being moved to a second position, as shown in FIG. 29, secured on the pair of leveling pads 110 at the forward ends of the lift arms. As previously described, each leveling pad has a vertical aperture 115 therein for retaining the bridge.

The lift bridge 14 comprises a generally rectangular plate 204 having a forward end 205, a rearward end 206, an upper surface 207, a bottom surface 208 and a pair of sides 209. The bottom surface has a pair of large cylindrical pins 210 extending downward from the center of each side (see FIG. 30). The pins are engageable with the apertures 115 in the leveling pads for retaining the lift bridge on the lift arms. (The leveling pads can further include optional cylindrical tubes or cups extending from the underside of the apertures, for further supporting and retaining the pins.)

The forward end of the plate has a forward flange 212 extending downward therefrom and the flange has a bottom edge 213 preferably shaped (concaved) to match with the contour of the rear cover 98 of the power unit. The rearward end of the plate has a rearward flange 214 extending downward therefrom and the flange has a bottom edge 215 also preferable shaped (concaved) to match with the contour of the rear cover of the power unit. The plate can further include optional side flanges (not shown) extending downward over the flange 114 of the leveling pads. The flanges provide substantial strength and rigidity to the plate of the bridge.

The bottom side of the plate further includes a central cylindrical boss 216 having a threaded aperture therein for receiving the threads of a screw-out saddle. For extended range, the bridge, preferably utilizes a unique double-screw-out-saddle 218 having a first threaded shaft 220 extending downward therefrom, and a second tubular shaft 222 having internal threads for receiving the screw threads of the first shaft 220 and having external threads for engaging the threaded aperture 216 in the boss at the center of the bridge. The double-screw-out-saddle in shown in its lowered position in FIGS. 29 and 30; and is shown in its fully extended position in FIG. 31.

The rectangular plate 204 of the bridge 14, including the pins 210, the flanges 213, 214, the central boss 216, and any additional flanges and ribs thereon can be fabricated by a welding process, but is preferably produced by an integral casting thereof.

The rear cover 98, at the rearward end of the power unit, and longitudinally along one side thereof further includes a large aperture 224 therein for receiving the threaded shaft 222 extending from the bottom of the bridge (inserted therein, not threaded); and further includes a pair of apertures 226 for receiving the pins 210 extending from the bottom of the bridge. The apertures 224, 226, along with the contoured flanges 213, 214 allow the bridge to be compactly and securely stored in its position on the cover. Due to the low profile of the power unit and the space occupied by the hydraulic cylinder (see also FIG. 24) the bridge can only be conveniently nested longitudinally along either side of the rear cover. It is shown preferably stored along the right side thereof for convenience for operators that are operating the handle controls with their right hand.

Commercial Power Unit—Automatic-Slide-Forward-Bridge

Figures 32, 33:
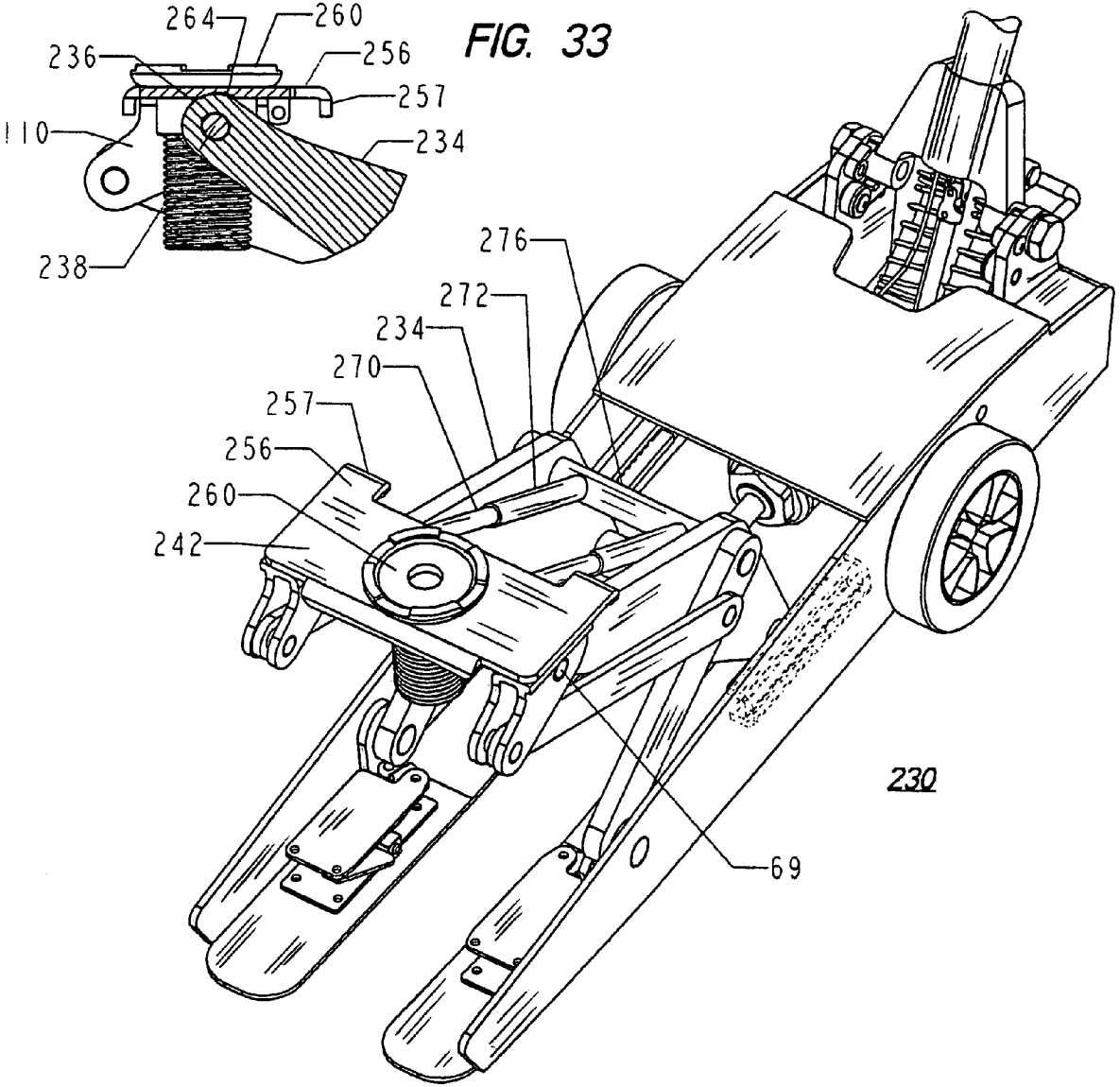
FIG. 32 is a top-front perspective top of another embodiment of present invention-showing the automatic-slide-forward-bridge and spring assembly.
FIG. 33 is a sectional view taken along 33-33 of FIG. 32 showing the forward ends of the lift arms engaged with recesses in the bottom of the bridge.
Figure 34:
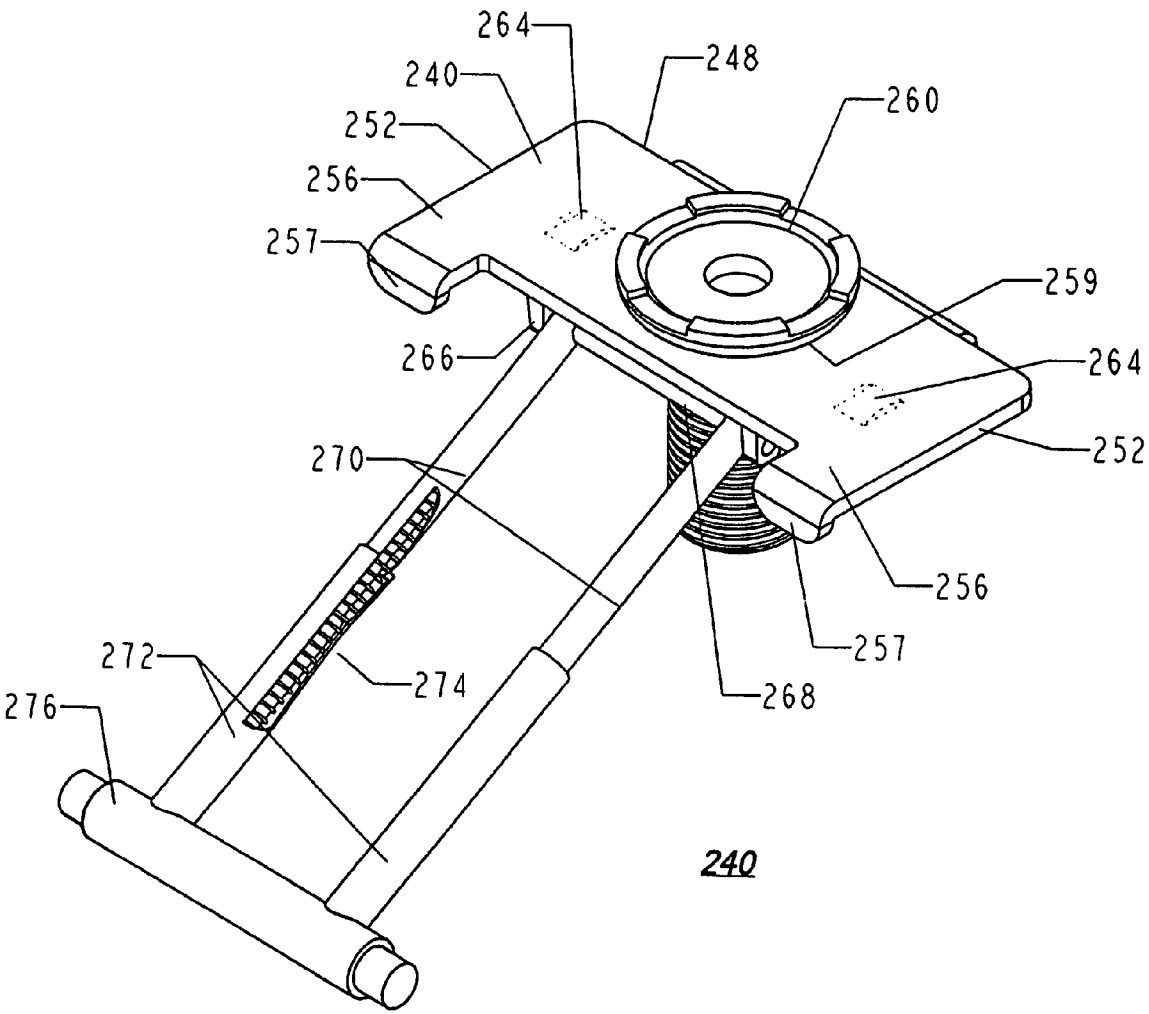
FIG. 34 is a top-front perspective view of the automatic-slide-forward-bridge and spring assembly as shown in FIG. 32.

Referring now to FIGS. 32-34, a second embodiment of the two-part lifting system is shown wherein a power unit 230 incorporates an improved automatic-slide-forward-bridge assembly 240. Briefly, the slide forward bridge is slidably retained on the upper surfaces of the lift arms and is always biased toward the forward ends thereof. When the power unit has jack stands loaded in the frame thereof, the jack stands automatically push the bridge rearward along the lift arms, and the power unit is operable for use with the jack stands. When there are no jack stands in the frame of the power unit, and the lift arms are lowered to their lowest position in the frame, the bridge is automatically biased onto the forward ends of the lift arms, and the power unit is operable for use directly as a load lifting jack.

The power unit 230 features the same components and inter-engagement of the components as previously discussed in reference to power unit 10, except the power unit 230 does not incorporate the two-position bridge 14, does not require the apertures 115 in the leveling pads 114, does not require the apertures in the cover 98, and includes a new pair of lift arms 232 (that are slightly different from the lift arms 68 of power unit 10).

The present lift arms 232 have a generally flat upper surface 234 and have forward ends 236 that are somewhat extended in length (about 0.25 inches more) beyond the pivot connection 238 at the forward ends thereof, and are otherwise interconnected as previously discussed.

The slide-forward-bridge is fabricated from a steel casting comprising a generally rectangular (horizontally oriented) plate 242 having a generally flat upper surface 244, a bottom surface 246, a forward end 248, a rearward end 250 and a pair of sides 252. Each side 252 of the plate includes a longitudinal inner channel 254 in the bottom thereof for engaging the outward flange 114 of each leveling pad 110; and includes a finger 256 extending rearward from the upper surface having a downward end flange 257 for abutting the rearward edge of each leveling pad. The plate further includes a cylindrical boss 258, extending downward from the center of the plate having a central vertical threaded aperture 259 therein for receiving the threaded shaft of a screw-out saddle 260.

The plate 12 further includes an inner securing plate 262 soldered along the lower outer edge of each channel providing an inward flange for engaging (the underside of) the outward flange 114 of the respective leveling pad. The bottom surface of the plate includes a pair of recesses 264 for receiving the extended forward ends 236 of the lift arms (when the lift are rotated upward as shown in FIG. 33). The recesses having the forward ends of the lift arms engaged therein, lock the bridge to the leveling pads, and prevent the bridge from slipping rearward therefrom. When the lift arms are lowered, the extended forward ends rotate out of engagement with the recesses, and the bridge can slide along the lift arms biased forward in the usual manner.

See particularly FIG. 34, the plate further includes a pair of centered flanges 266 extending downward from the bottom near the rearward end thereof. The flanges are machined with apertures to receive a lateral pivot pin 268. The lateral pivot pin supports a set of telescoping tubular sleeves 270, 272, as part of the automatic-slide-forward-bridge assembly.

The first pair of sleeves 270, suitably formed from tubular galvanized steel, are each connected at one end thereof in parallel to the lateral pivot pin 268. A pair of compression springs 274 are inserted within the first pair of sleeves. The springs and the free ends of the first pair of sleeves are telescopically inserted into the second pair of tubular sleeves 272. The second pair of sleeves are connected at the free ends thereof in parallel to a lateral support axel 276. This collection of components comprises the slide-forward-bridge-assembly 240.

The lateral support axel 276 is fixedly secured between the lift arms at 104 (the connection of the connecting arms) The automatic slide forward bridge assembly is biased toward the forward ends of the lift arms, but can only be positioned on the leveling pads when the lift arms in their lowest position and aligned with the flanges of the leveling pads, whereby the bridge automatically snaps into the forward position by the compression springs of the assembly.

It is concluded that the foregoing designs and materials of the commercial power units and the commercial jack stands describe features, components and assemblies that are robust to manufacture and that provide reliable and durable commercial use. The improved jack stand describes a self-centering and self-aligning lift plate; and a robust durable dual locking mechanism for controlling the frames. The improved power unit describes a frame for efficiently loading the jack stands and maneuvering the power unit; and a handle with improved controls for operating the jack stands, and for easily locking the angle of the handle in a fixed position for efficient movement, shipment and storage of the power unit.

An improved two-position bridge component is described that can be stored in one position on the cover of the power unit, and manually positioned on the lift arms for converting the power unit directly into a load lifting device. An improved automatic-slide-forward-bridge is also described having components that are robust to produce and assemble, and that are reliable and durable in commercial use.

While specific embodiments and examples of the present invention have been illustrated and described herein, it is realized that modifications and changes will occur to those skilled in the art. It is therefore to be understood that the appended claims are intended to cover all such modifications and changes as may fall within the spirit and scope of the invention.

The invention claimed is:

1. A mobile commercial power unit for use with a jack stand, and for use with a lift bridge; said power unit comprising:

a generally rectangular frame having a central longitudinal axis; a forward end for operating a jack stand; a middle portion for retaining the lifting mechanism; a rearward end for controlling the power unit; a bottom thereof having an elongated rectangular slot, that is a little wider than the width of the base assembly of the jack stand, with the slot opening in the forward end of the bottom and extending to the middle portion thereof, and having a pair of separated elongated extensions extending from the respective side of the slot to the side of the frame, for straddling one or more of the jack stands and retaining the jack stand in the slotted opening therein; and a rearward portion that is angled longitudinally upwardly a few degrees for facilitating mobility of the power unit, and having a hydraulic cylinder with a control valve and an actuator piston thereon attached along the longitudinal center thereof, a pair of longitudinal flanges extending upwardly from the bottom of said frame, with each flange having a "U" shaped retaining channel facing inwardly and attached horizontally along the middle portion of said frame, and having a pair of wheels attached to the exterior sides of the flanges on lateral axels near the rearward end of said frame;

a pair of lift arms acting in parallel having forward ends, central portions and rearward ends and interconnected at the rearward ends thereof by a lateral push bar, and with the respective end of said push bar slidably retained within the respective longitudinal retaining channel of said frame; and with the forward ends of said lift arms extendable upwardly at the forward end of said frame;

a pair of frusta-conical disc pivotally attached to the inner sides of the forward ends of each lift arm, with the greater diameter of the discs extending inwardly so that the upper surface thereof inclines upwardly at an acute angle ranging from about 15° to about 30°, for engaging a lifting plate of the jack stand;

a pair of connecting arms acting in parallel having forward ends and rearward ends with the respective forward end pivotally connected near the forward end of the respective flange of said frame, and with the respective rearward end pivotally connected near the central portion of said respective lift arm; and the hydraulic cylinder having an extendable and retractable ram at the forward end thereof attached to said lateral push bar; so that when the ram is extended, the rearward ends of said lift arms are translated forward along the longitudinal retaining channels in the respective flange of said frame and the forward ends of said lift arms are extended upwardly at the forward end of said frame.

2. The commercial power unit as defined in claim 1, wherein the pair of separated elongated extensions have laterally rounded noses thereon and have a length for extending about 1.50 inches beyond the forward-most end of a positioned jack stand.

3. The commercial power unit as defined in claim 1, further comprising:

a rear cover extending from the side flanges at the rearward end of the frame and over the cylinder, with the cover having an aperture therein for receiving a shaft extending from the bottom of the lift bridge and a pair of apertures therein for also receiving pins extending from the bottom of the lift bridge; and a pair of leveling pads pivotally attached to the outer sides of the forward ends of said lift arms for providing a level platform thereon and having a vertical aperture therein for receiving pins extending from the bottom of the lift bridge.

4. The commercial power unit as defined in claim 3, wherein each of said leveling pads further include a rectangular plate having a first lever arm extending downward and forwardly at an angle from the plate, and the rectangular plate having an upper edge thereon and a flange extending horizontally outward therefrom providing the level platform thereon and having another flange extending downward from the level platform having a second lever arm extending parallel downward and forwardly therefrom, and having a mating lateral apertures therein; and a pair of leveling links each connected at one end to the first and second lever arms, and connected at the other end to a point on the connecting arm; so that as said lift arms are raised and lowered, the level platform of the leveling pads are maintained in a substantially horizontal orientation.

5. The commercial power unit as defined in claim 1, wherein the tubular handle has a yoke at the distal end thereof with lateral axels thereon pivotally attached to the side of the rearward end of the frame, and the yoke further has a pair of flanges extending rearward therefrom supporting a lateral axel and a cylindrical cam thereon for engaging each actuator piston on the hydraulic cylinder upon successive down strokes of the tubular handle, wherein the mechanism for controlling and positioning the tubular handle further comprises:

a generally cylindrical disc fixed vertically to one of the lateral axels of the tubular handle and having a plurality of radial notches in the periphery thereof; and a lever arm pivotally attached at one end thereof to the frame adjacent to and extending generally tangentially to said notched disc, and having a lug thereon projecting toward said disc and having a lever handle at the other end thereof extending beyond the rearward end of the frame for actuation thereof by the toe of an operator, wherein said lever is pivotable in one direction for engaging the lug into one of the notches of said disc to thereby fix the position of the handle in a desired angle relative to the frame, and said lever is pivotable in the other direction for disengaging the lug from the notches of said disc so that the handle is free to pivot about the lateral axels for engaging the actuator pistons of the cylinder, and free to be folded forward over the frame for compact shipping and storage of the power unit.

6. The commercial power unit as defined in claim 5 further comprising:

a second cylindrical disc vertically attached to the other lateral axel of the tubular handle and having a plurality of matched radial notches in the periphery thereof; and a second lever arm pivotally attached at one end thereof to the frame adjacent to and extending generally tangentially to said second notched disc, and having a lug thereon projecting toward said second disc and having a lever handle at the other end thereof extending rearward beyond the rearward end of the frame and extending laterally and interconnected to said first lever arm in a U shaped manner;

a fixed retaining clip for retaining at least one of said lever arms in a first position so that the lugs of said lever arms are fixed into engagement with the respective notches in said notched discs for positioning the power unit, and alternatively for retaining said lever arms into a second position so that the lugs of said lever arms are fixed into disengagement with the notches of said discs, so that the tubular handle can be pumped to actuate the hydraulic cylinder or folded over the power unit for storage.

7. The commercial power unit as defined in claim 6 wherein each of said cylindrical discs has a first notch therein for locking the handle at an acute angle for maneuvering and positioning the power unit into a desired location; and a second notch for locking the handle at a very low, generally flat angle for maneuvering and positioning the power unit into a confined desired location; and further including a pawl pivotally attached to the frame adjacent to and biased to pivot into the periphery of at least one of said cylindrical disc wherein said cylindrical disc has a third notch therein that is engageable by said pawl when the handle is at about the vertical position, so that the handle does not fall forward over the power unit at an undesired time; and said pawl is rotatable away from said notched disc for folding the handle over the power unit at a desired time.

8. The commercial power unit as defined in claim 1 wherein the lift bridge is an automatic-slide-forward lift bridge, and wherein the forward ends of said lift arms have a pair of leveling pads pivotally attached to the outer sides thereof, wherein each said leveling pad includes a generally rectangular plate oriented vertically having a rearward edge and an upper edge with a longitudinal flange extending outward from the upper edge thereon for use with the lift bridge, and for use with a means for biasing the lift bridge toward the forward ends of the lift arms, said slide-forward lift bridge, having a rectangular plate with an upper surface, a bottom surface, a forward end, a rearward end and having a threaded aperture in the center thereof with a screw-out saddle having a threaded shaft engaged therein, and a pair of sides, with each side having an inner longitudinal channel in the bottom thereof for engaging the outward flange of the respective leveling pad, and each side further having a finger extending rearward from the rectangular plate with a flange extending downward therefrom for abutting the rearward edge of said leveling pad; and means for biasing said slide-forward bridge toward the forward ends of said lift arms.

9. The commercial power unit as defined in claim 8 wherein the forward ends of the lift arms are elongated beyond the pivot connection of the leveling pads, and the bottom surface of said rectangular plate further includes recesses therein for receiving the elongated ends of the lift arms when in the elevated position, for locking the slide-forward-bridge onto the lift arms.

10. The commercial power unit as defined in claim 9, wherein the bottom surface of said lift bridge has a pair of lateral flanges extending downward therefrom with apertures therein, and further comprising:

a lateral pivot pin retained within the apertures of the lateral flanges of said bridge;

a lateral support axel attached between the rearward ends of said lift arms;

a first pair of tubular sleeves having forward ends attached to the lateral pivot pin and having rearward ends extending longitudinally and parallel between said lift arms;

a second pair of tubular sleeves having rearward ends for attaching to the lateral support axel; and a pair of compression spring inserted into each rearward end of said first sleeve; and each rearward end of said first sleeve and said compression spring are telescopically inserted into each forward end of said second sleeve and the rearward end of said second sleeves are attached to the support axel.

11. The mobile commercial power unit as defined in claim 1, further including a handle and control mechanism for aligning a jack stand therein, comprising:

a tubular handle at the rearward end of said frame having a T bar hand grip at the proximal end thereof and a yoke at the distal end thereof with lateral axels thereon pivotally attached to the sides of the rearward end of the frame, and the yoke further having a pair of flanges extending rearward therefrom supporting a lateral axel and a cylindrical cam thereon for engaging each actuator piston on successive down strokes of the tubular handle;

a rotatable control knob extending through the T bar hand grip; a control shaft extending from the control knob through the tubular handle to the distal end thereof; a universal joint attached at one end to the control shaft at a length, so that the center of the u-joint is between the axels of the yoke at the distal end of the tubular handle; and a coupling shaft having one end connected to the control valve of the cylinder and having the other end thereof connected to the end of said u-joint;

an alignment pin block horizontally and transversely attached to each forward extension, at a desired location for aligning the jack stand therein;

an alignment pin slidably supported within each pin block having a distal end extending horizontally and inwardly from said pin block for being received within the alignment hole of the jack stand, and having a proximal end with spring means thereon for biasing the alignment pin inwardly, and having a pin tab attached to the outermost proximal end thereof;

a pair of horizontally oriented, generally rectangular shaped flippers pivotally mounted at the inner rearward corner thereof to each forward extension, and each flipper having an arcuate inner edge which is selectively engageable with the associated ratchet release arm of the jack stand, and each flipper having an outer edge which has a downward extending tab that fits within the pin tab of the associated alignment pin and is selectively engagable to retract the associated alignment pin, wherein said tubular handle further has an operating lever on said handle, and control means coupling said operating lever to the outer rearward corners of both of said flippers, thereby controlling both ratchet release members and both of said locking pins, for controlling the attachment of the power unit to a jack stand, the release and non-release of the jack stand pawls, and the detachment of the power unit from the jack stand.

12. The mobile commercial power unit as defined in claim 11, wherein the coupling means further includes said tubular handle having an opening located in the right side and near the proximal end thereof and adjacently below the T bar hand grip, the opening having a "P" shape with a lower notch, and with a separate intermediate notch, and with an upper edge therein;

a torsion tube pivotally attached laterally between the side flanges of the frame forward of the yoke at the distal end of the tubular handle, and having an actuator arm attached near the center and extending rearwardly and downwardly therefrom, and having a pair of pull arms attached near the lateral ends thereof and extending downwardly therefrom;

biasing spring means urging said pull arms toward the forward end of the power unit;

an attachment member slideably disposed within the tubular handle at the P-shaped opening therein;

the control lever being attached at the inner end to the attachment member and having the other end extending outward from the opening in the tubular handle for use by the operator;

a control rod having a proximal end attached to said attachment member and having a distal end extending through the tubular handle to the distal end thereof, a second universal joint attached to the distal end of said control rod, so that the center of the second u-joint is between the axels of the yoke at the distal end of the tubular handle;

a coupling rod having one end connected to the actuator arm extending from said torsion tube and having the other end thereof connected to said second u-joint;

a pair of operating rods each having a proximal end attached to a pull arm, and having a distal end attached to the outer rearward corner of the respective flipper.

* * * * *